US011639787B2

(12) United States Patent
Lee et al.

(10) Patent No.: US 11,639,787 B2
(45) Date of Patent: May 2, 2023

(54) MAGNETIC ASSEMBLY STRUCTURE

(71) Applicant: TAIWAN OASIS TECHNOLOGY CO., LTD., New Taipei (TW)

(72) Inventors: Wei-Long Lee, New Taipei (TW); Shih-Meng Liao, New Taipei (TW)

(73) Assignee: TAIWAN OASIS TECHNOLOGY CO., LTD., New Taipei (TW)

( * ) Notice: Subject to any disclaimer, the term of this patent is extended or adjusted under 35 U.S.C. 154(b) by 358 days.

(21) Appl. No.: 17/027,925

(22) Filed: Sep. 22, 2020

(65) Prior Publication Data

US 2021/0003270 A1 Jan. 7, 2021

Related U.S. Application Data

(63) Continuation-in-part of application No. 16/014,180, filed on Jun. 21, 2018, now Pat. No. 10,813,415.

(51) Int. Cl.

| | |
|---|---|
| ***H01F 7/02*** | (2006.01) |
| ***F21V 21/096*** | (2006.01) |
| ***F21V 21/30*** | (2006.01) |
| ***H01R 13/62*** | (2006.01) |
| ***H01R 11/30*** | (2006.01) |
| ***H01R 4/00*** | (2006.01) |

(52) U.S. Cl.

CPC ..... *F21V 21/096* (2013.01); *F21V 21/30* (2013.01); *H01F 7/0263* (2013.01); *H01R 4/54* (2013.01); *H01R 11/30* (2013.01); *H01R 13/6205* (2013.01)

(58) Field of Classification Search

CPC ..... H01R 13/6205; H01R 11/30; H01R 4/54; H01F 7/0263

See application file for complete search history.

(56) References Cited

U.S. PATENT DOCUMENTS

| | | | | |
|---|---|---|---|---|
| 3,520,033 | A * | 7/1970 | Usuda | A44B 11/2588 24/DIG. 38 |
| 6,292,985 | B1 * | 9/2001 | Grunberger | A44B 11/2592 24/616 |
| 8,684,760 | B1 * | 4/2014 | Lam | H01R 13/6276 439/348 |
| 9,961,966 | B2 * | 5/2018 | Ryan | A44B 1/14 |
| 10,070,697 | B1 * | 9/2018 | Melgoza | A44C 3/001 |
| 2002/0000024 | A1 * | 1/2002 | Grunberger | A44B 11/2592 24/303 |

(Continued)

*Primary Examiner* — Jason W San

(74) *Attorney, Agent, or Firm* — Demian K. Jackson; Jackson IPG PLLC

(57) ABSTRACT

The present disclosure relates to a magnetic assembly structure which utilizes a magnetic attraction or repulsion effect generated by two magnetic components to make two buckle structures automatically engaged to each other. The magnetic assembly structure of the present disclosure has a first main body and a second main body, and via the hardware design of disposing magnetic components and buckle structures respectively on the first main body and the second main body, the first and second main bodies rotate in respect to each other due to the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced.

21 Claims, 36 Drawing Sheets

(56) References Cited

U.S. PATENT DOCUMENTS

| | | | | |
|---|---|---|---|---|
| 2007/0259536 | A1* | 11/2007 | Long | H01R 31/06 439/39 |
| 2010/0325844 | A1* | 12/2010 | Fiedler | A44B 11/25 24/303 |
| 2011/0138583 | A1* | 6/2011 | Fiedler | A44B 11/25 24/303 |
| 2012/0124792 | A1* | 5/2012 | Ooki | F16B 5/0642 24/606 |
| 2012/0284969 | A1* | 11/2012 | Fullerton | G01D 18/00 24/303 |
| 2013/0045623 | A1* | 2/2013 | McGregor | H01R 13/5205 24/115 R |
| 2015/0313328 | A1* | 11/2015 | MacKay | A44C 15/0015 362/104 |
| 2016/0183642 | A1* | 6/2016 | Fiedler | A44B 99/005 24/628 |
| 2017/0172262 | A1* | 6/2017 | Paik | A44B 11/2588 |
| 2017/0317446 | A1* | 11/2017 | Byrne | H01R 11/30 |
| 2018/0160779 | A1* | 6/2018 | Fildan | A41F 1/006 |
| 2018/0368533 | A1* | 12/2018 | Chan | A44B 11/2592 |
| 2019/0069648 | A1* | 3/2019 | Duncan | H01F 7/0263 |
| 2020/0044386 | A1* | 2/2020 | Pabouctsidis | H01R 13/24 |
| 2021/0003270 | A1* | 1/2021 | Lee | F21V 21/096 |
| 2022/0045456 | A1* | 2/2022 | Johnson | H01R 13/6205 |

* cited by examiner

MAGNETIC ASSEMBLY STRUCTURE

CROSS REFERENCE

The present invention is Continuation-in-part application of U.S. patent application Ser. No. 16/014,180 filed on 2018 Jun. 21, wherein all contents of the references which priorities are claimed by the present invention are included in the present invention, herein.

BACKGROUND

1. Technical Field

The present disclosure relates to a magnetic assembly structure, in particular, to a magnetic assembly structure which utilizes a magnetic attraction or repulsion effect generated by two magnetic components to make two buckle structures automatically engaged to each other.

2. Description of Related Art

Generally, to assemble two main bodies to an object, a screwing way can be used by screws, or an engaging or snapping way can be used by buckle structures. For example, a thermos cup has a cup body and a cup cover, which respectively have a male screw and female screw, and thus a rotating way can be used to snap the male screw and the female screw. Usually, a left hand is used to hold the cup body, and a right hand is used to rotate the cup cover, by the way of snapping the male screw and the female screw and rotating the cup cover in respect to the cup body, the cup cover is screwed to the cup body, such that the water in the thermos cup will not leak out. However, when the left hand is used to hold one other object, being unable to hold the cup body, the cup cover is therefore unable to be screwed to the cup body; or alternatively, the one other object should be laid aside to make the left hand free to hold the cup body; or alternatively, a help of one other person for holding the cup body is required. Similarly, when rotating the cup cover to leave from the cup body, it faces the abovementioned problems.

For another example, mentioned in TW Patent M548766, one projection lamp is provided, comprising a lamp case, a glass plate (i.e. lamp mask) and a buckle unit, and the buckle unit is used to engage the glass plate to the lamp case. Such manner not only needs the independent buckle unit, the left hand for holding the lamp case and the right hand for holding the glass plate, but also needs a help of one other person for simultaneously engaging the buckle unit to the lamp case and the glass plate. Similarly, when uninstalling the projection lamp to exchange the inner component, a help of one other person for detaching the buckle unit is also required.

Taking a ceiling lamp for another example, the ceiling lamp comprises a lamp base and a lamp mask. The installation of the ceiling lamp is to use a screw to penetrate screw holes disposed on the lamp base and the lamp mask, and then to screw them tightly. However, such installation has the following disadvantages: (1) it is very troublesome that the screw is screwed tightly after the two screw holes disposed on the lamp base and the lamp mask must be aligned precisely; (2) since the lamp mask is usually made of by glass and has a certain degree of weight, the hand or holding the lamp mask is required when aligning the screw holes, which not only needs a strong force, but also ease the lamp mask to fall down to cause a danger. Similarly, when uninstalling the lamp mask, the left hand for hold the lamp mask and the right hand for rotating the screw are also needed, thus consuming force and causing unsafety.

According to the technical features in the mentioned related art, whenever installing and uninstalling the thermos cup, the projection lamp and the ceiling lamp, two hands are required to operate simultaneously, even a help of one other person is required for achieving the installation and uninstallation, which causes time consuming, force consuming, inconvenience and unsafety.

Therefore, how to ease the installation and uninstallation of an apparatus by a novel hardware design and how to efficiently reduce the installation cost and expensing time are still the issues which the industrial developer and related research and design person continuously try to overcome and solve.

SUMMARY

One objective of the present disclosure is to provide a magnetic assembly structure, in particular, a magnetic assembly structure which utilizes a magnetic attraction or repulsion effect generated by two magnetic components to make two buckle structures automatically engaged to each other. Therefore, it actually eases the installation and uninstallation of the appliance to which the magnetic assembly structure is applied, and the costs of installation and consuming time are reduced.

According to one objective of the present disclosure, the applicant provides a magnetic assembly structure, at least comprising: a first main body, comprising at least one first buckle structure, the first buckle structure is a flange, and a top part of the first buckle structure is formed with a groove; and a second main body, comprising at least one second buckle structure, the second buckle structure is a bump, and the second buckle structure is received by the groove, such that the bump is able to move in the groove; wherein the second main body and the first main body mutually generate a magnetic attraction or repulsion effect, so as to automatically rotate the second main body and first main body in respect to each other, and to automatically move the second buckle structure from one end of the groove to interior of the groove, thereby engaging the bump and the groove and engaging the second buckle structure and the first buckle structure.

Regarding the above magnetic assembly structure, the first main body has at least one upper conductive point, and the second main body has at least one lower conductive point. After the second main body and first main body automatically rotate in respect to each other, and the bump and the groove are engaged with each other, the upper conductive point and the lower conductive point contact and conduct each other.

Regarding the above magnetic assembly structure, the first main body further comprises at least one upper limit part, and the second main body comprises at least one lower limit part. After the second main body and first main body automatically rotate in respect to each other, and the bump and the groove are engaged with each other, the upper limit part and the lower limit part engage to each other to achieve an limit effect, and thus the upper conductive point and the lower conductive point contact and conduct each other.

According to one objective of the present disclosure, the applicant provides a magnetic assembly structure, at least comprising: a first main body, comprising at least one first buckle structure and at least one upper conductive point; and a second main body, comprising at least one second buckle structure and at least one lower conductive point; wherein the second main body and the first main body mutually generate a magnetic attraction or repulsion effect, so as to automatically rotate the second main body and first main body in respect to each other, thereby engaging the second buckle structure and the first buckle structure, and making the upper conductive point and the lower conductive point contact and conduct each other.

Accordingly, the magnetic assembly structure of the present disclosure, via the hardware design of disposing magnetic components and buckle structures respectively on the first main body and the second main body, makes the first and second main bodies rotate in respect to each other due to the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DESCRIPTION OF THE EXEMPLARY EMBODIMENTS

Figure 1:
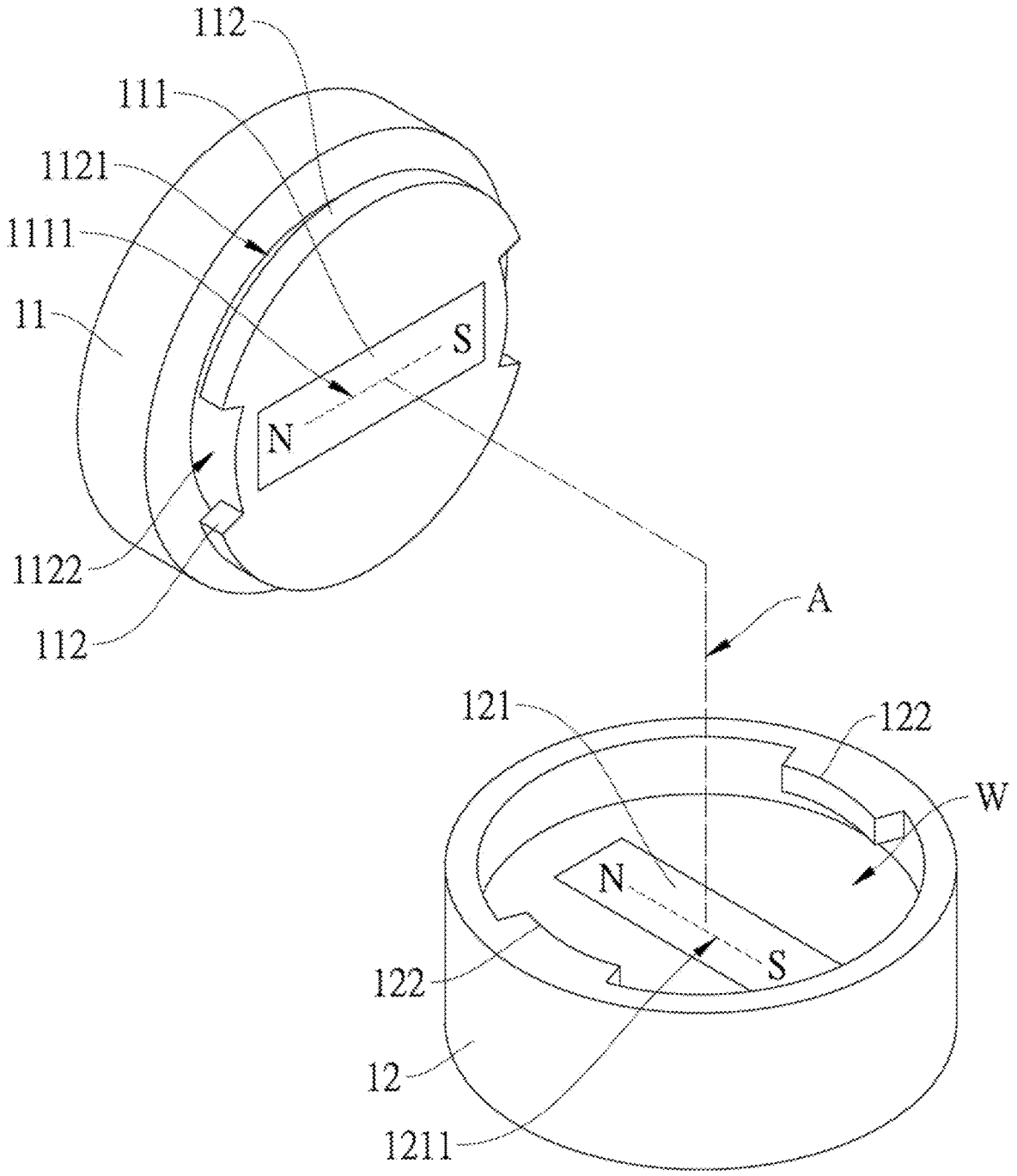
FIG. 1 is an explosive diagram of a magnetic assembly structure according to a first embodiment of the present disclosure.

To facilitate understanding of the present disclosure, the following descriptions are provided to illustrate exemplary embodiments of the present disclosure together with drawings. It is noted that the following drawings are used for illustration of the present disclosure and not intended to limit the actual dimension, ratio and alignment. Therefore, ratios and allocations of the components in the drawings will not limit the scope of the present disclosure.

Firstly, referring to FIG. 1, FIG. 2A, FIG. 2B, FIG. 3A and FIG. 3B, as shown in such drawings, the magnetic assembly structure (1) of the present disclosure at least comprises a first main body (11) and a second main body (12).

The first main body (11) comprises at least one first magnetic component (111) and at least one first buckle structure (112). In one preferred embodiment, the first magnetic component (111) is formed in a square shape, a rectangular shape, a U-shape or a circular shape, and an N pole and a S pole of the first magnetic component (111) are disposed on the two ends of the rectangle, for example, the N and S poles of the first magnetic component (111) are disposed on the two ends of the long axis of the rectangle. A connection line of the N and S poles of the first magnetic component (111) form a first magnetic axis (1111). The first buckle structure (112) is disposed at one of the right and left sides of the first magnetic component (111), or the first buckle structure (112) is disposed at one of the right and left sides of the first magnetic axis (1111). In the embodiment, the first buckle structure (112) is a protrusion edge, and top of the first buckle structure (112) is formed with a groove (1121). A tail terminal of the first buckle structure (112) is formed with a notch (1122), and the groove (1121) communicates with the notch (1122). Preferably, the first main body (11) comprises the first magnetic component (111) and the two first buckle structures (112), and the two first buckle structures (112) are respectively and symmetrically disposed at the left and right sides of the first magnetic component (111), or the two first buckle structures (112) are respectively and symmetrically disposed at the left and right sides of the first magnetic axis (1111). The first buckle structure (112) are disposed with a gap to form the two notches (1122) being symmetrical to each other. The first buckle structure (112) can be disposed on any position of the first main body (11). Preferably, the first buckle structure (112) is disposed at the edge of the first main body (11). Further preferably, the first buckle structure (112) is disposed at the edge of the bottom side of the first main body (11).

The second main body (12) comprises at least one second magnetic component (121) and at least one second buckle structure (122). Similar to the first main body (11), the second magnetic component (121) is formed in a square shape, a rectangular shape, a U-shape or a circular shape, and an N pole and a S pole of the second magnetic component (121) are disposed on the two ends of the rectangle, for example, the N and S poles of the second magnetic component (121) are disposed on the two ends of the long axis of the rectangle. A connection line of the N and S poles of the second magnetic component (121) form a second magnetic axis (1211). The second buckle structure (122) is disposed at one of the right and left sides of the second magnetic component (121), or the second buckle structure (122) is disposed at one of the right and left sides of the second magnetic axis (1211). In the embodiment, the second buckle structure (122) is a protrusion block. Preferably, the second main body (12) comprises the second magnetic component (121) and the two second buckle structures (122), and the two second buckle structures (122) are respectively and symmetrically disposed at the left and right sides of the second magnetic component (121), or the two second buckle structures (122) are respectively and symmetrically disposed at the left and right sides of the second magnetic axis (1211). The second buckle structure (122) can be disposed on any position of the second main body (12). Preferably, the second buckle structure (122) is disposed at the edge of the second main body (12). Further preferably, the second buckle structure (122) is disposed at the edge of the top side of the second main body (12).

The second buckle structure (122) is capable of penetrating through the notch (1122), and the width of the protrusion block is less than that of the notch (1122), such that the protrusion block is capable of penetrating through the notch (1122). The second buckle structure (122) can be accommodated in the groove (1121), and for example, when the thickness of the protrusion block is less than or equal to the width of the groove (1121), the protrusion block is capable of moving within the groove (1121).

When the first main body (11) and the second main body (12) mutually close to assemble and form a magnetic assembly structure (1), the second magnetic component (121) and the first magnetic component (111) mutually generate the magnetic attraction effect to rotate the second main body (12) and first main body (11) in respect to each other, thereby engaging the second buckle structure (122) and the first buckle structure (112) each other. In addition, the first main body (11) and the second main body (12) are rotated in respect to each other via a rotation axis (A), wherein the rotation axis (A) is a connection line of a central of the first magnetic component (111) and a central of the second magnetic component (121), a central of the first main body (11), a central of the second main body (12) or a connection line of the central of the first main body (11) and the central of the second main body (12).

Figure 2A:
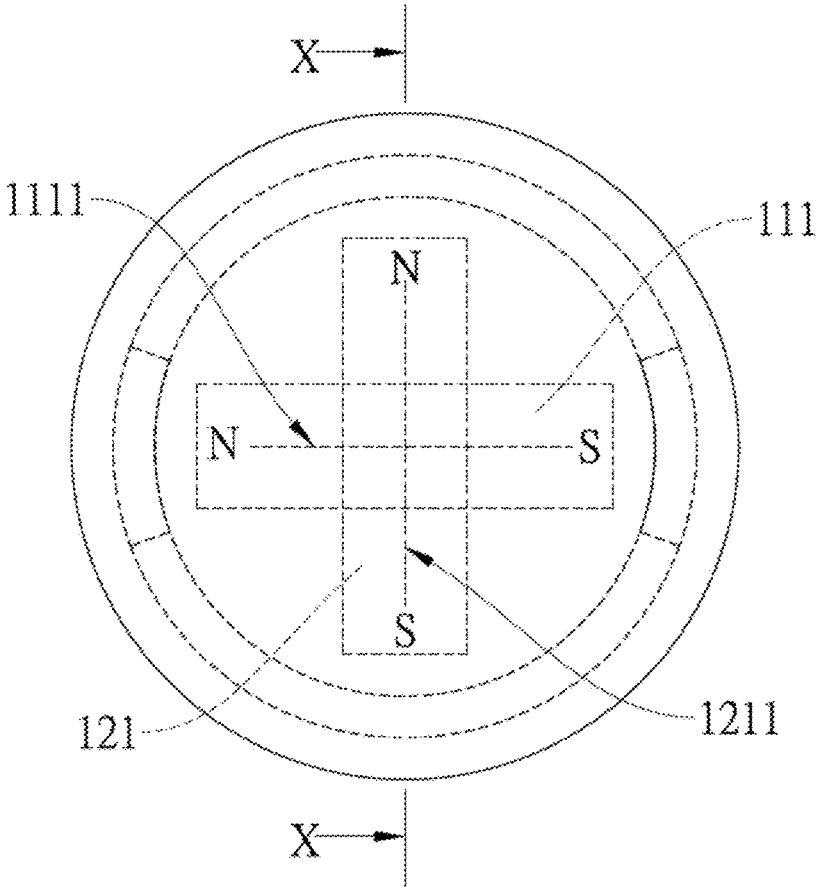
FIG. 2A is a schematic diagram showing the first main body and second main body of the magnetic assembly structure mutually close according to the first embodiment of the present disclosure.
Figure 2B:
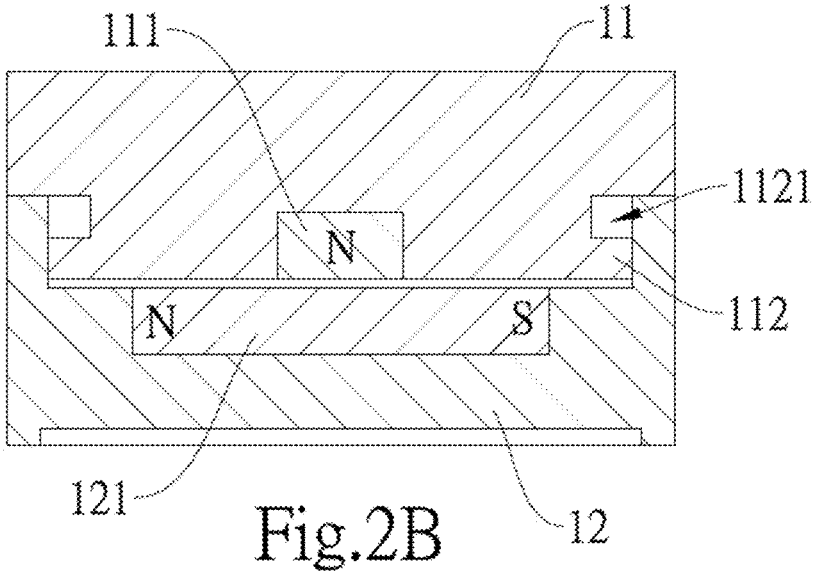
FIG. 2B is sectional view of FIG. 2A of a line X-X.
Figure 3A:
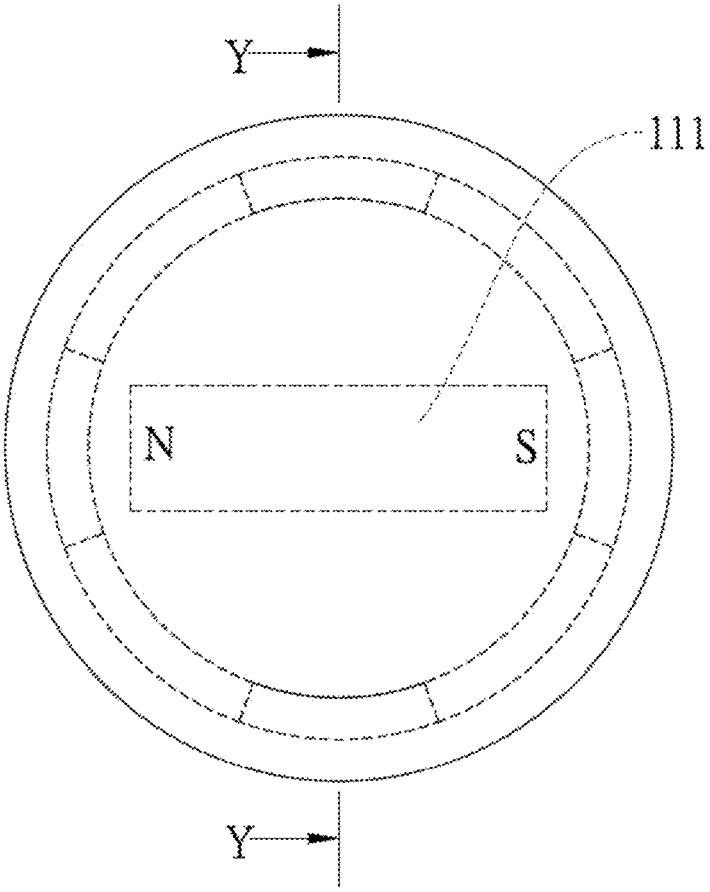
FIG. 3A is a schematic diagram showing an operation of the magnetic assembly structure according to the first embodiment of the present disclosure.
Figure 3B:
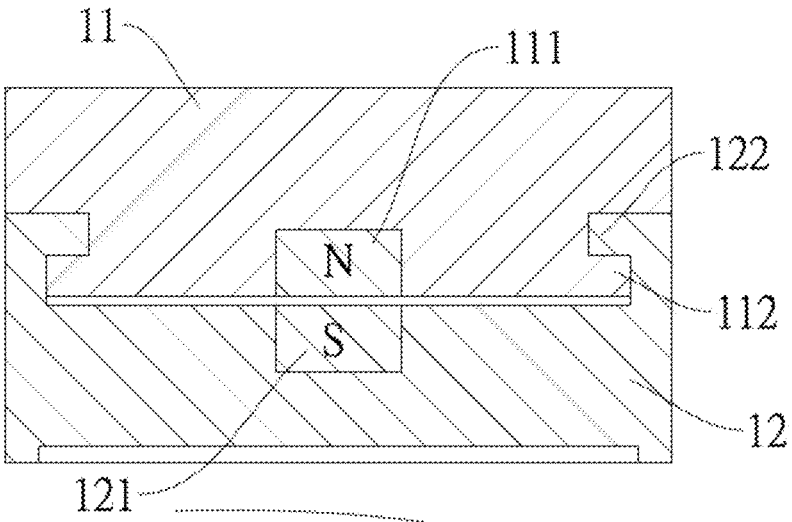
FIG. 3B is sectional view of FIG. 3A of a line Y-Y.

In the first embodiment of the present disclosure, when the user start to make the first main body (11) and the second main body (12) mutually close, the second buckle structure (122) penetrates the notch (1122) and is disposed at the tail terminal of the groove (1121), and the first magnetic component (111) and the second magnetic component (121) are vertical to each other (as shown in FIG. 2A and FIG. 2B). Meanwhile, merely a little force is needed to slightly rotate the first main body (11) or the second main body (12), so as to make the first main body (11) or the second main body (12) be rotated slightly in respect to the rotation axis (A), and then, the N pole of the first main body (11) and the S pole of the second main body (12) generate the magnetic attraction effect, so as to make the first main body (11) or the second main body (12) be automatically rotated in respect to the rotation axis (A), for example, the second buckle structure (122) (i.e. or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other (as shown in FIG. 3A and FIG. 3B).

An N pole direction of the first magnetic component (111) and a S pole direction of the magnetic component (121) are intersected to form an angle (θ), or the first magnetic axis (1111) and the second magnetic axis (1211) are intersected to form the angle (θ), as shown in FIG. 2A. When the first main body (11) and the second main body (12) mutually close, and the angle (θ) is less than 90 degrees but larger than 0 degree, the second buckle structure (122) penetrates the notch (1122) and is disposed at the tail terminal of the groove (1121). Meanwhile, no force for rotating is required, and the first main body (11) and the second main body (12) are mutually and automatically rotated in respect to the rotation axis (A) due to the magnetic attraction effect generated by the N pole of the first magnetic component (111) and the S pole of the second magnetic component (121), for example, the second buckle structure (122) (or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other (as shown in FIG. 3A and FIG. 3B). Of course, the angle (θ) can be larger than 90 degrees, or equal to 90 degrees.

The magnetic assembly structure (1) can has an accommodation space (W), and the first main body (11) and the second main body (12) mutually close to form the accommodation space (W), or alternatively, the second main body (12) has the accommodation space (W), or alternatively, the first main body (11) has the accommodation space (W). In the embodiment, when the first buckle structure (112) and the second buckle structure (122) are engaged to each other, the first buckle structure (112) and the second buckle structure (122) are disposed between the first magnetic component (111) and the second magnetic component (121), or the first buckle structure (112) and the second buckle structure (122) are disposed at the edge of the middle part of the magnetic assembly structure (1).

Figure 4:
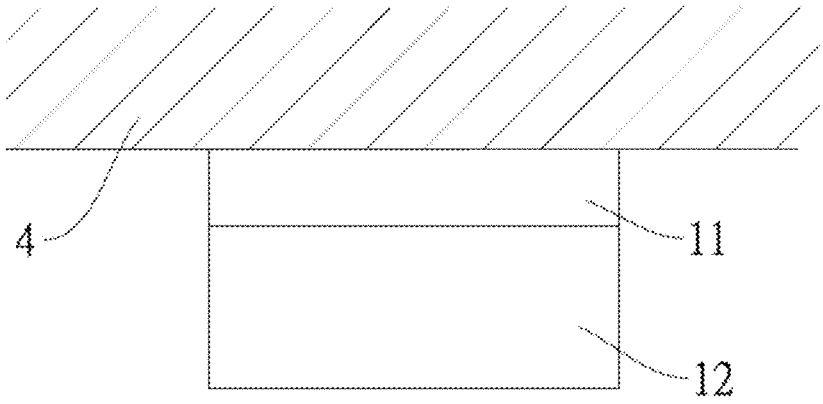
FIG. 4 is a schematic diagram showing an application of a ceiling lamp using the magnetic assembly structure of the present disclosure.
Figure 5:
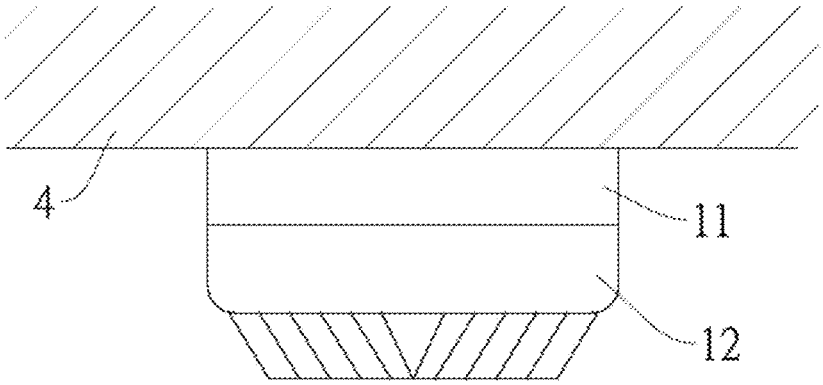
FIG. 5 is a schematic diagram showing an application of a smoke detector using the magnetic assembly structure of the present disclosure.

Refer to FIG. 4 and FIG. 5, which respectively illustrate embodiments of the magnetic assembly structures (1) being applied to a ceiling lamp (FIG. 4) and a smoke detector (FIG. 5). In the embodiment of the magnetic assembly structures (1) being applied to the ceiling lamp, the first main body (1) of the magnetic assembly structure (1) is a lamp case and disposed on the ceiling (4), and the lamp case is installed with an electronic circuit (not shown in drawings) and a lamp bulb (not shown in drawings). The second main body (12) is a lamp mask, and the lamp mask has the accommodation space (W) (as shown in FIG. 1). When installing the ceiling lamp, one user can uses merely one hand to hold the lamp mask, move the lamp mask close to the lamp case, and the lamp case and the lamp mask are mutually and automatically rotated due to the magnetic attraction effect of the magnetic component (111) and the magnetic component (121), so as to make the first buckle structure (112) and the second buckle structure (122) engaged to each other. When removing the lamp mask from the lamp case, the user merely reversely rotate the lamp mask to overcome the magnetic attraction effect of the magnetic component (111) and the magnetic component (121), the lamp mask can be removed from the lamp case without helps of other tool. Thus, when installing and uninstalling the ceiling lamp, no other user's help is required. After assembling the lamp case and the lamp mask, the lamp bulb can be received in the accommodation space (W).

In the embodiment of the magnetic assembly structures (1) being applied to the smoker detector, the first main body (11) of the magnetic assembly structure (1) is a base body being disposed on the ceiling (4). The second main body (12) is the smoke detector, the smoke detector and the base body are mutually and automatically rotated due to the magnetic attraction effect of the magnetic component (111) and the magnetic component (121), so as to make the first buckle structure (112) and the second buckle structure (122) engaged to each other.

It is noted that, the first magnetic component (111) is a magnet or an iron product, the second magnetic component (121) is a magnet or an iron product, and at least one of the first magnetic component (111) and the second magnetic component (121) is magnet, wherein the magnet is a permanent magnet or an electromagnet.

Figure 6A:
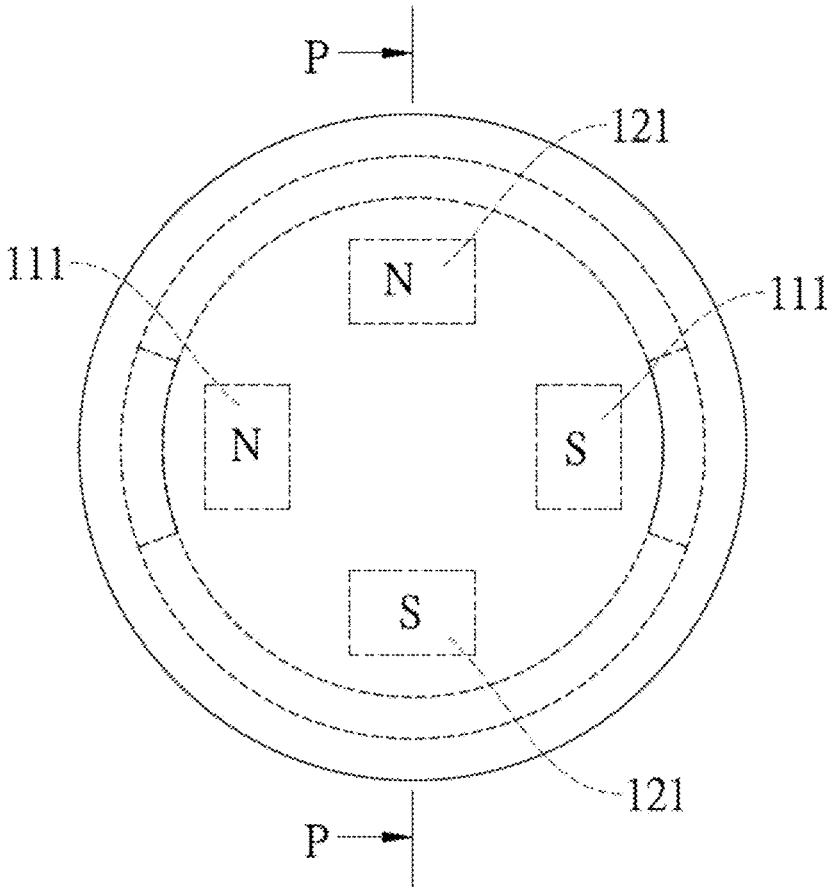
FIG. 6A is a schematic diagram showing the first main body and second main body of the magnetic assembly structure mutually close according to a second embodiment of the present disclosure.
Figure 6B:
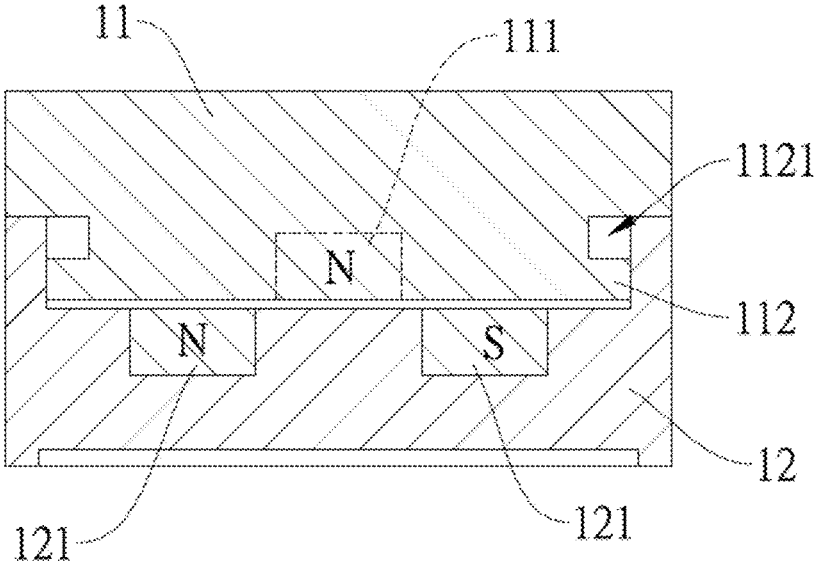
FIG. 6B is sectional view of FIG. 6A of a line P-P.

Furthermore, referring to FIG. 6A, FIG. 6B, FIG. 7A and FIG. 7B simultaneously, which illustrate a second embodiment of the magnetic assembly structure of the present disclosure, the first main body (11) comprises the two first magnetic components (111) and the two first buckle structures (112), wherein the two first magnetic components (111) are symmetrically disposed on the first main body (11), and the two first buckle structures (112) are symmetrically disposed on the first main body (11). The second main body (12) also comprises the two second magnetic components (121) and the two second buckle structures (122), the two second magnetic components (121) are symmetrically disposed on the second main body (12), and the two second buckle structures (122) are symmetrically disposed on the second main body (12). The two first magnetic components (111) are poles of same polarities, for example, both of them are the N poles or the S poles, and the two second magnetic components (121) are poles of same polarities, wherein the polarity of the pole of the first magnetic component (111) is different from that of the second magnetic component (121); or alternatively, the two first magnetic components (111) are poles of different polarities, for example, one is the N pole and another one is the S pole, and the two second magnetic components (121) are poles of different polarities, as shown in FIG. 6A. It is noted the following implementations are also practicable, at least one of the two first magnetic components (111) is a magnet, and at least one of the two second magnetic components (121) is an iron product; or alternatively, at least one of the two second magnetic components (121) is a magnet, and at least one of the two first magnetic components (111) is an iron product.

Figure 7A:
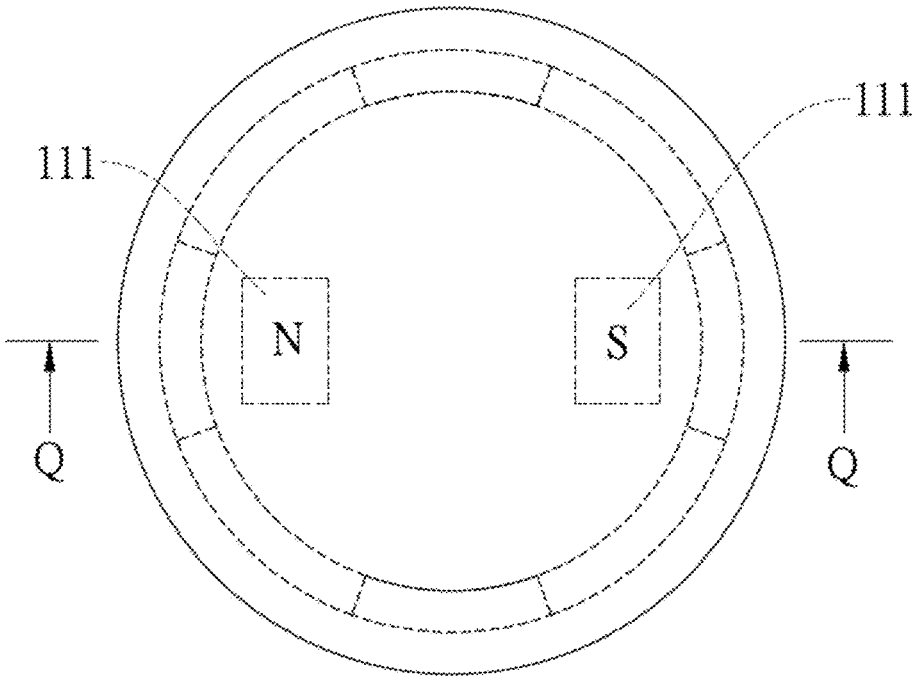
FIG. 7A is a schematic diagram showing an operation of the magnetic assembly structure according to the second embodiment of the present disclosure.
Figure 7B:
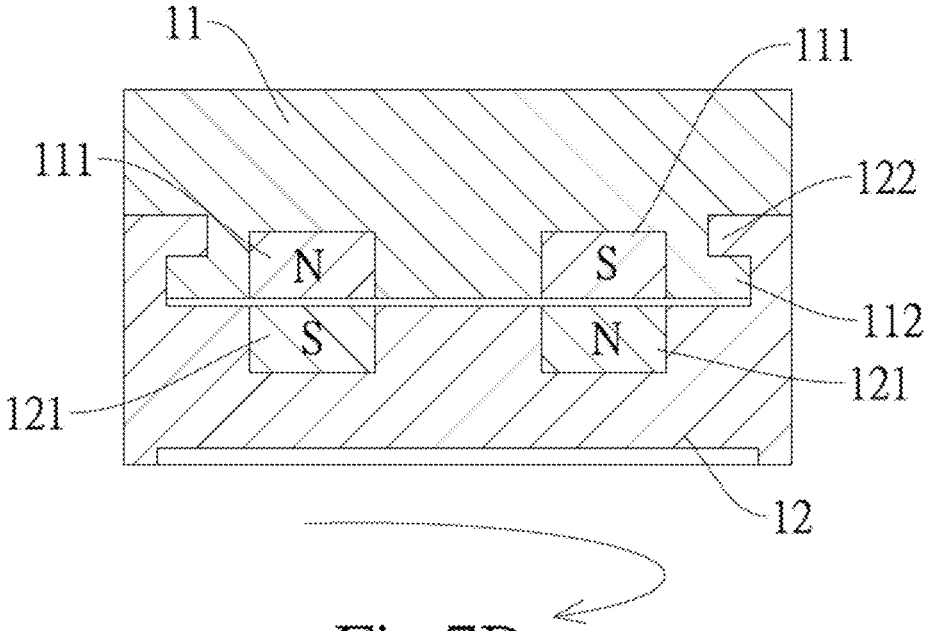
FIG. 7B is sectional view of FIG. 7A of a line Q-Q.
Figure 8:
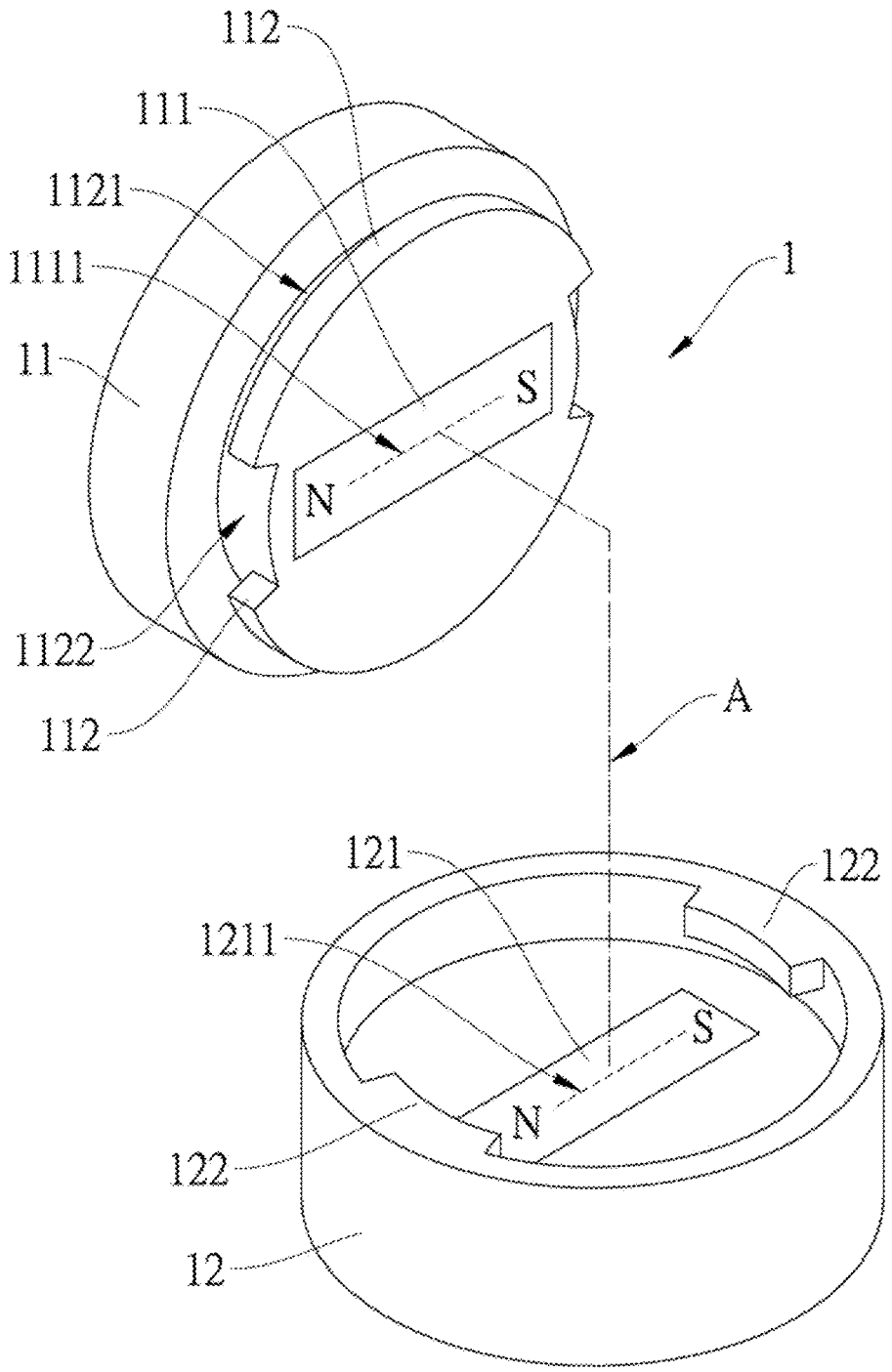
FIG. 8 is an explosive diagram of a magnetic assembly structure according to a third embodiment of the present disclosure.
Figure 9A:
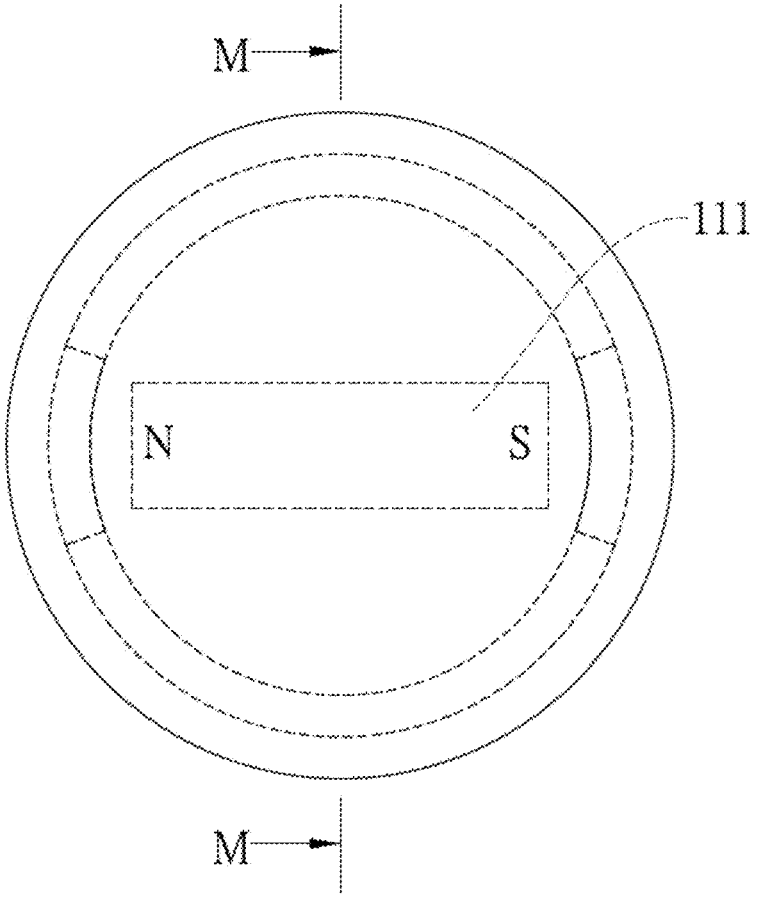
FIG. 9A is a schematic diagram showing the first main body and second main body of the magnetic assembly structure mutually close according to the third embodiment of the present disclosure.
Figure 9B:
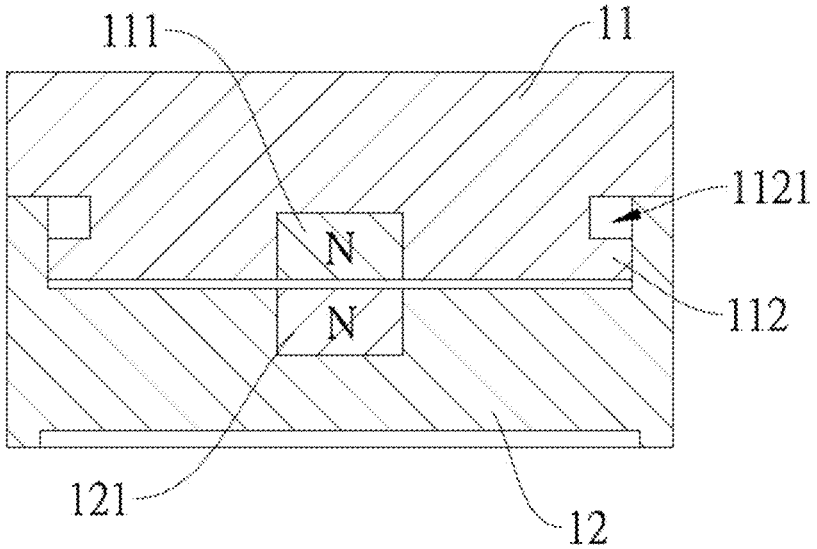
FIG. 9B is sectional view of FIG. 9A of a line M-M.
Figure 10A:
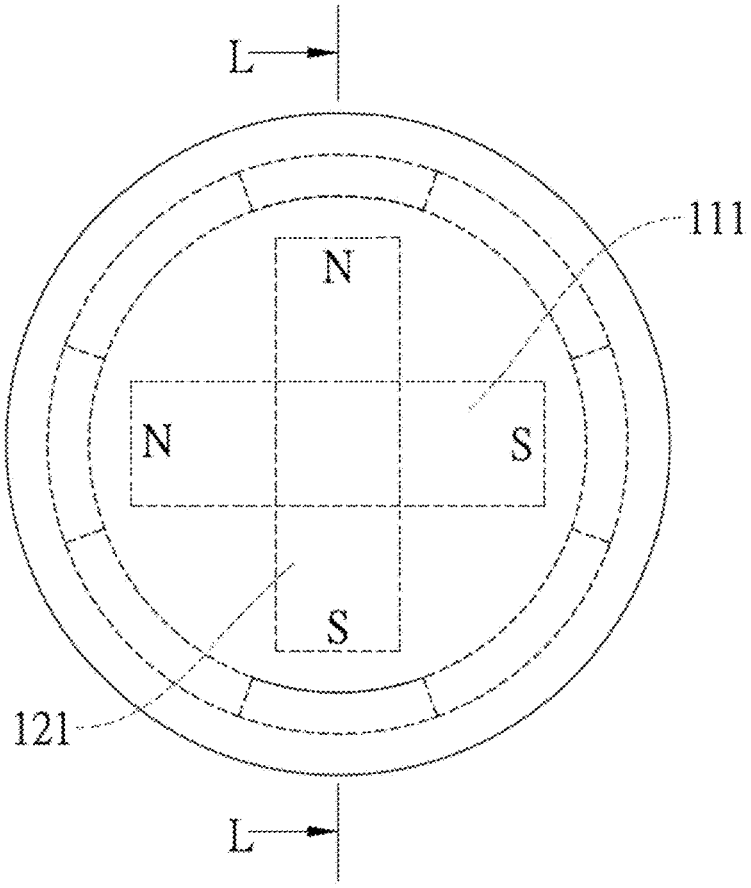
FIG. 10A is a schematic diagram showing an operation of the magnetic assembly structure according to the third embodiment of the present disclosure.
Figure 10B:
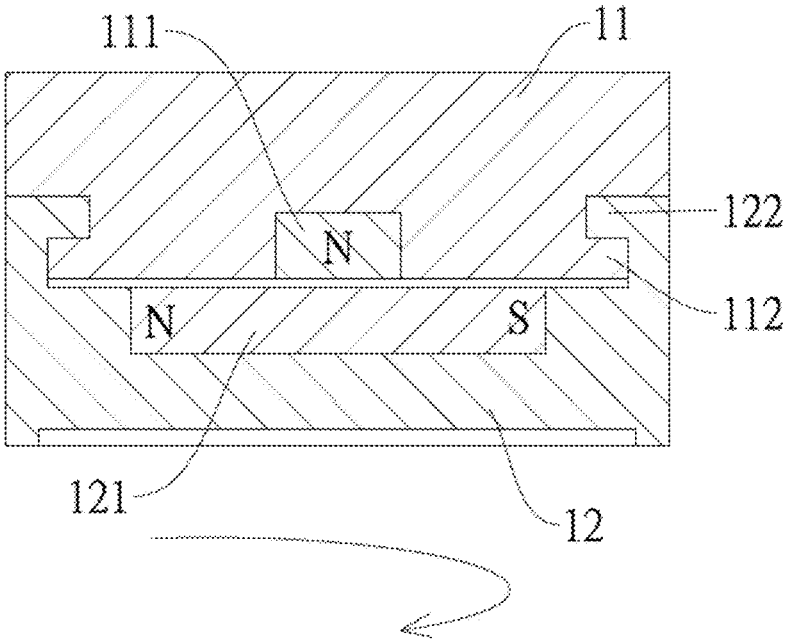
FIG. 10B is sectional view of FIG. 10A of a line L-L.
Figure 11A:
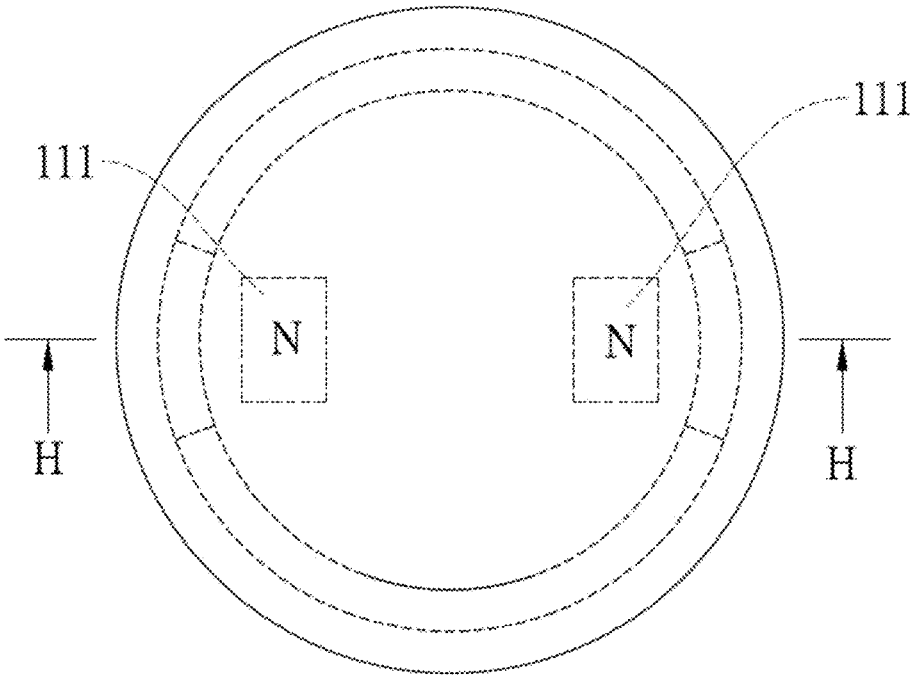
FIG. 11A is a schematic diagram showing the first main body and second main body of the magnetic assembly structure mutually close according to a fourth embodiment of the present disclosure.
Figure 11B:
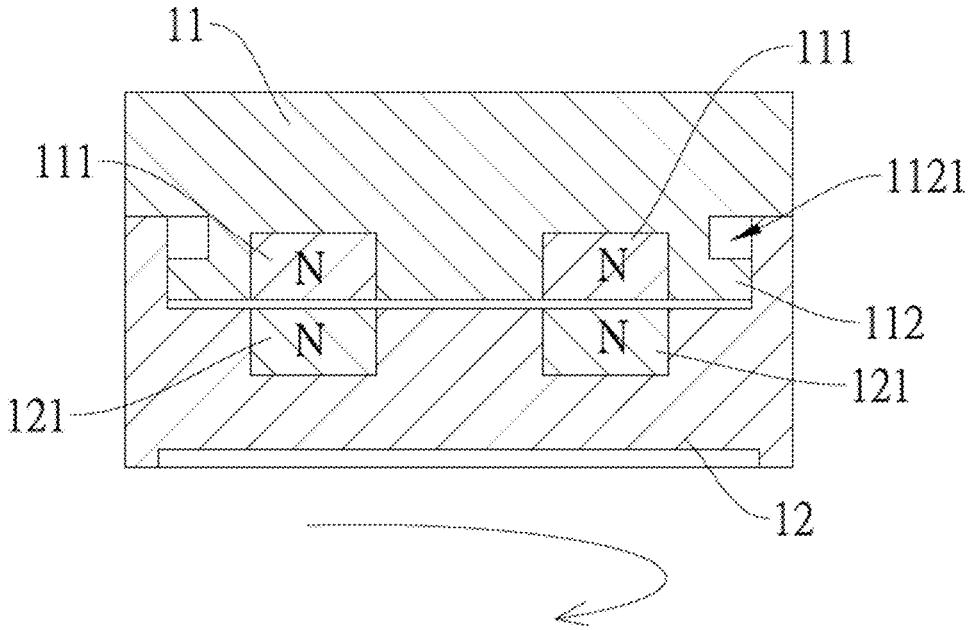
FIG. 11B is sectional view of FIG. 11A of a line H-H.
Figure 12A:
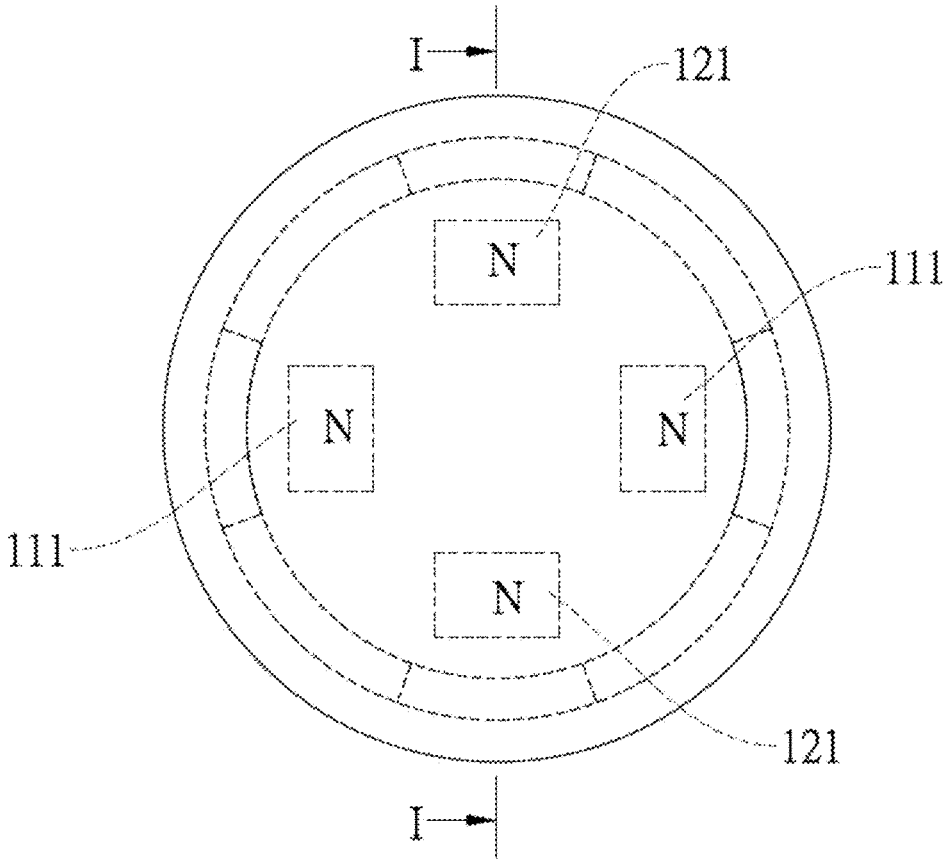
FIG. 12A is a schematic diagram showing an operation of the magnetic assembly structure according to the fourth embodiment of the present disclosure.
Figure 12B:
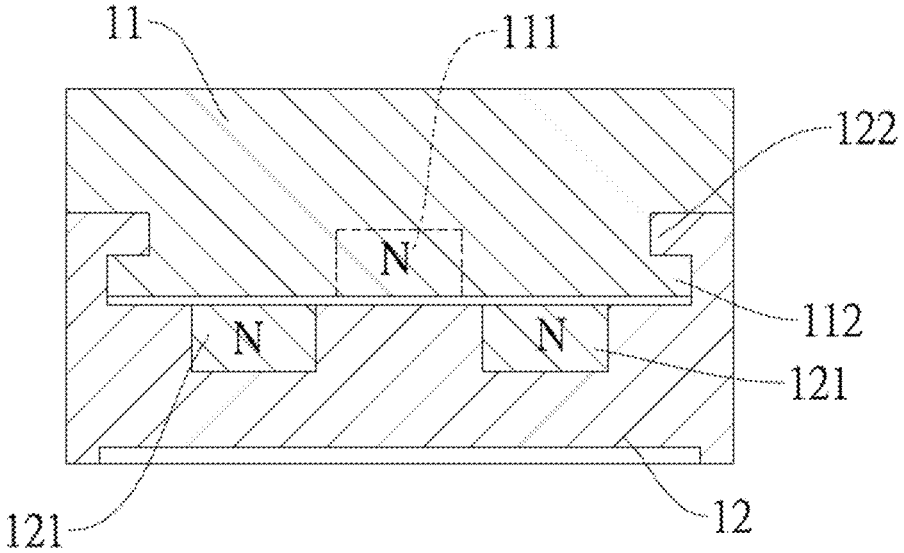
FIG. 12B is sectional view of FIG. 12A of a line I-I.
Figure 13A:
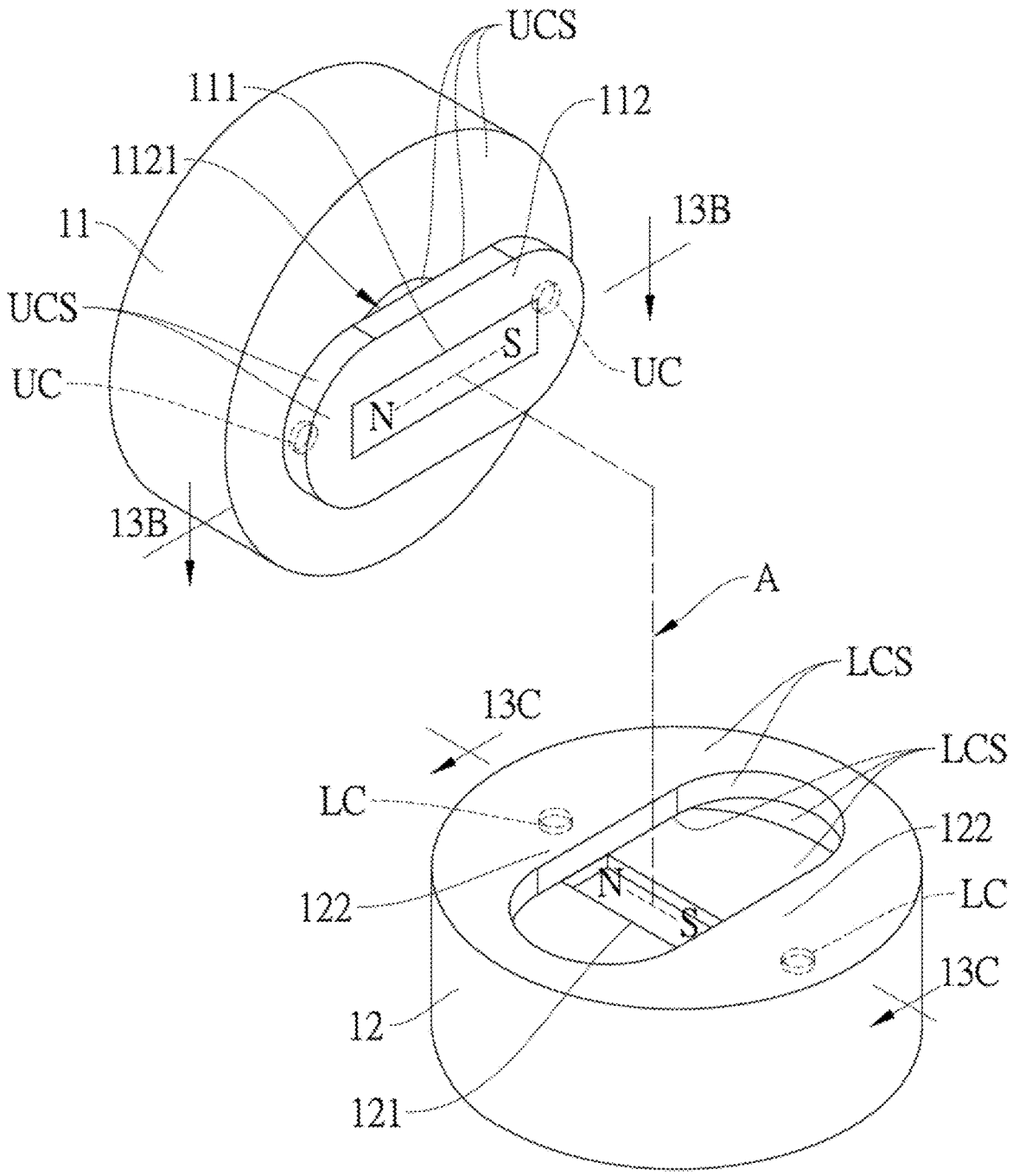
FIG. 13A is an explosive diagram of a magnetic assembly structure according to a fifth embodiment of the present disclosure.
Figure 13B:
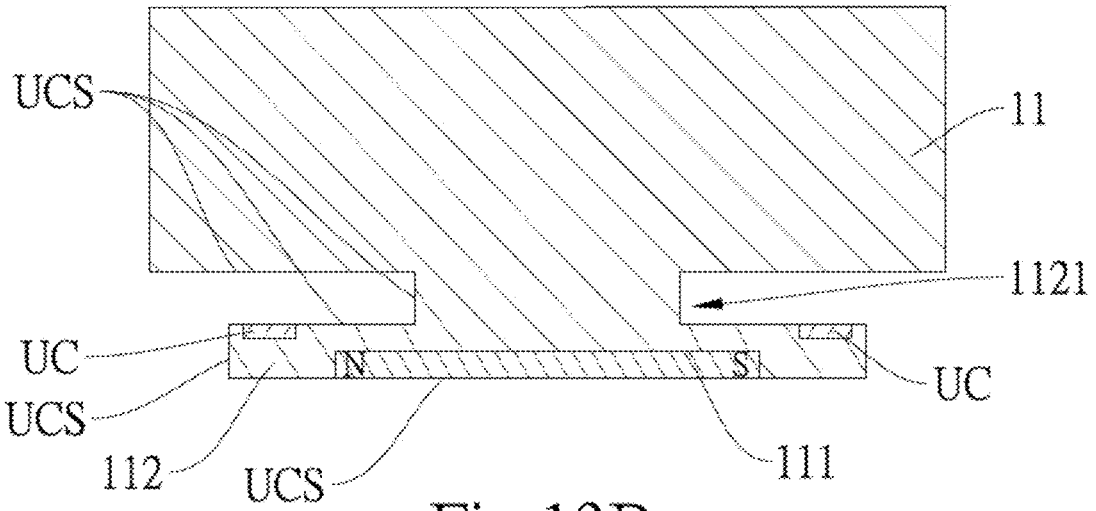
FIG. 13B is sectional view a first main body of FIG. 13A of a line 13B-13B.
Figure 13C:
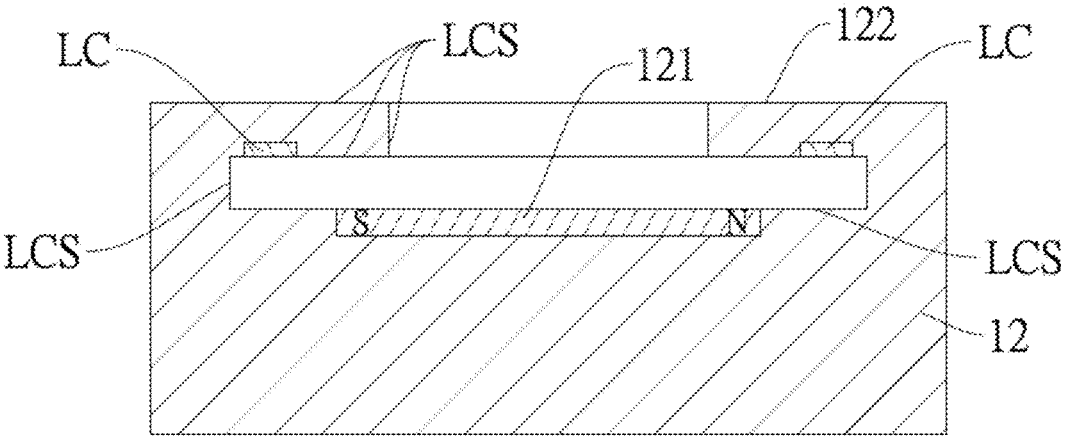
FIG. 13C is sectional view a second main body of FIG. 13A of a line 13C-13C.
Figure 13D:
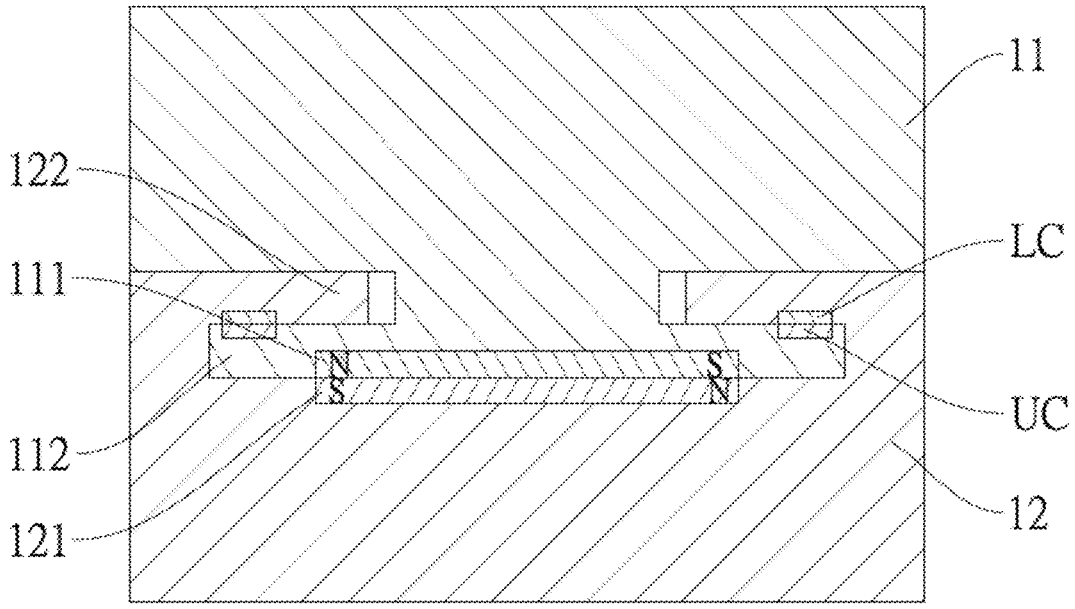
FIG. 13D is a sectional diagram showing the first main body and second main body of FIG. 13A mutually close.
Figure 14A:
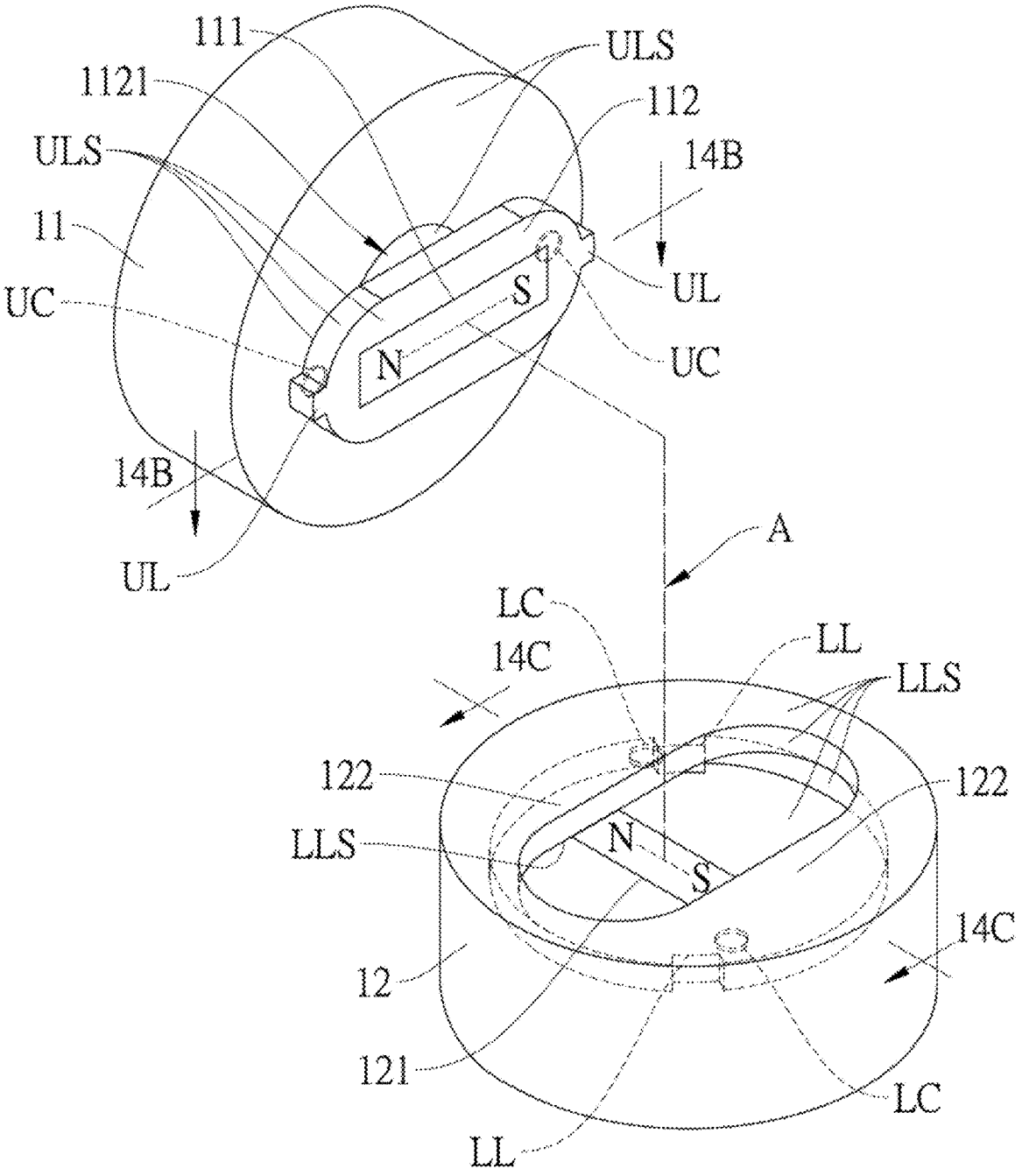
FIG. 14A is an explosive diagram of a magnetic assembly structure according to a sixth embodiment of the present disclosure.
Figure 14B:
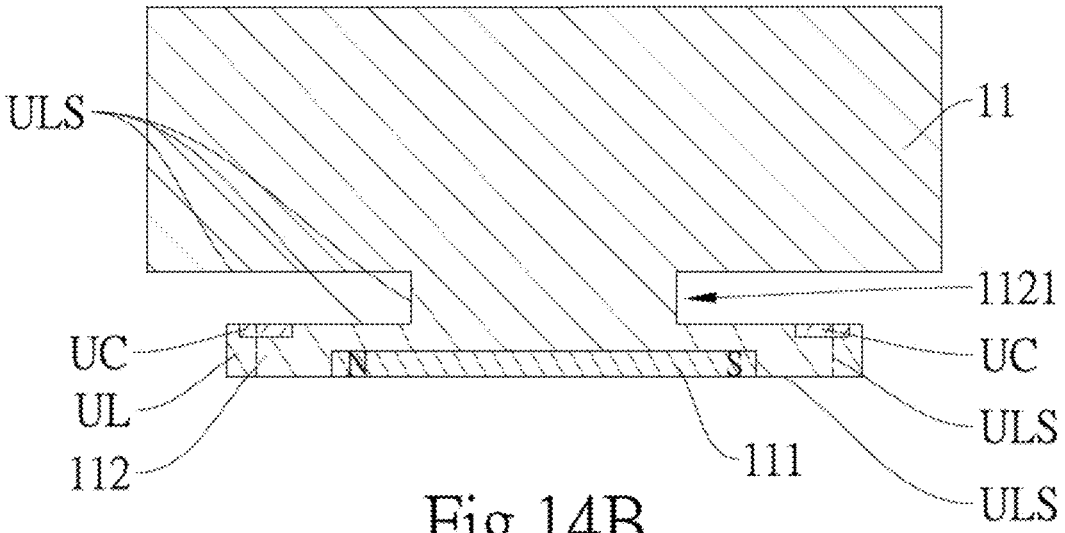
FIG. 14B is sectional view a first main body of FIG. 14A of a line 14B-14B.
Figure 14C:
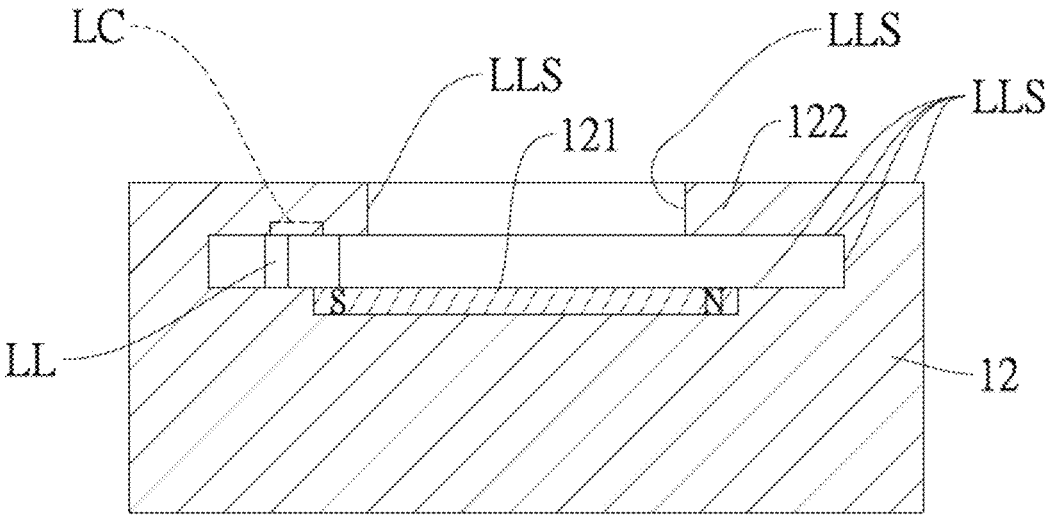
FIG. 14C is sectional view a second main body of FIG. 14A of a line 14C-14C.
Figure 14D:
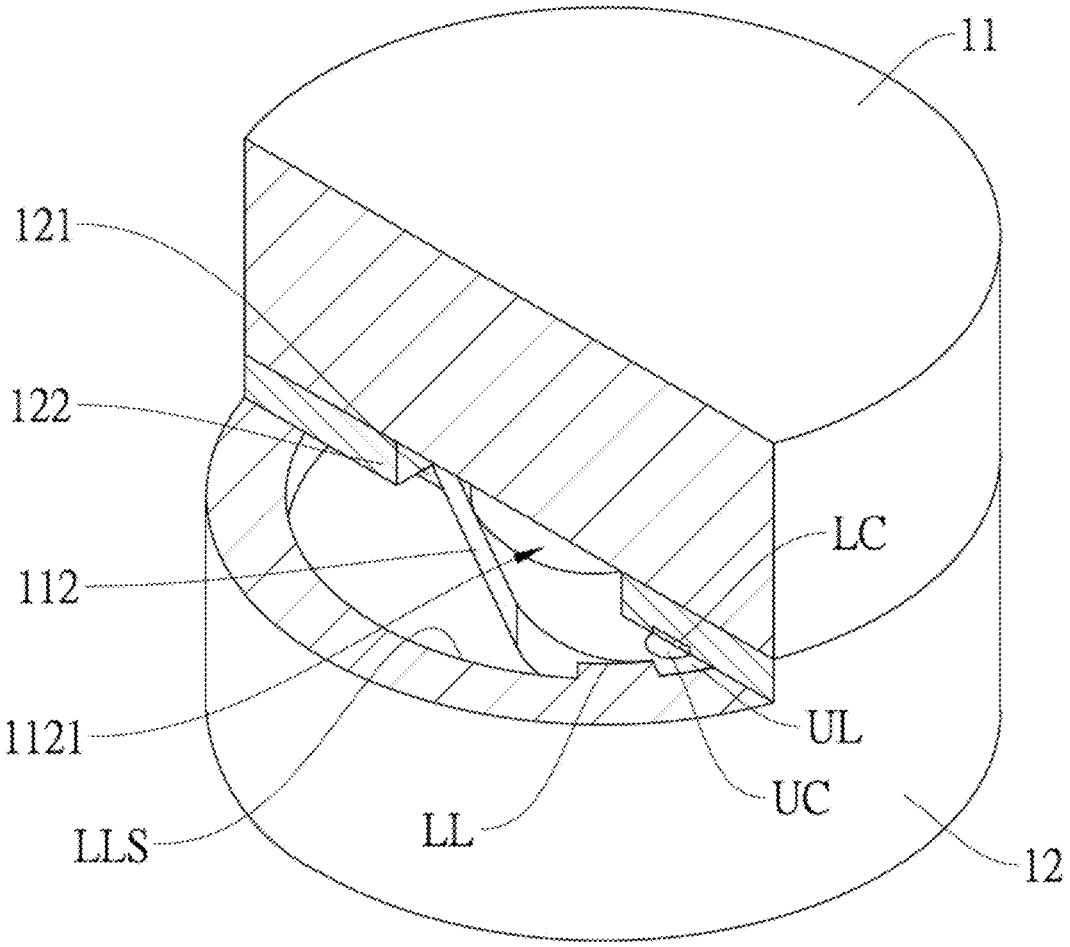
FIG. 14D is a 3D sectional diagram showing the first main body and second main body of FIG. 14A mutually close.
Figure 15A:
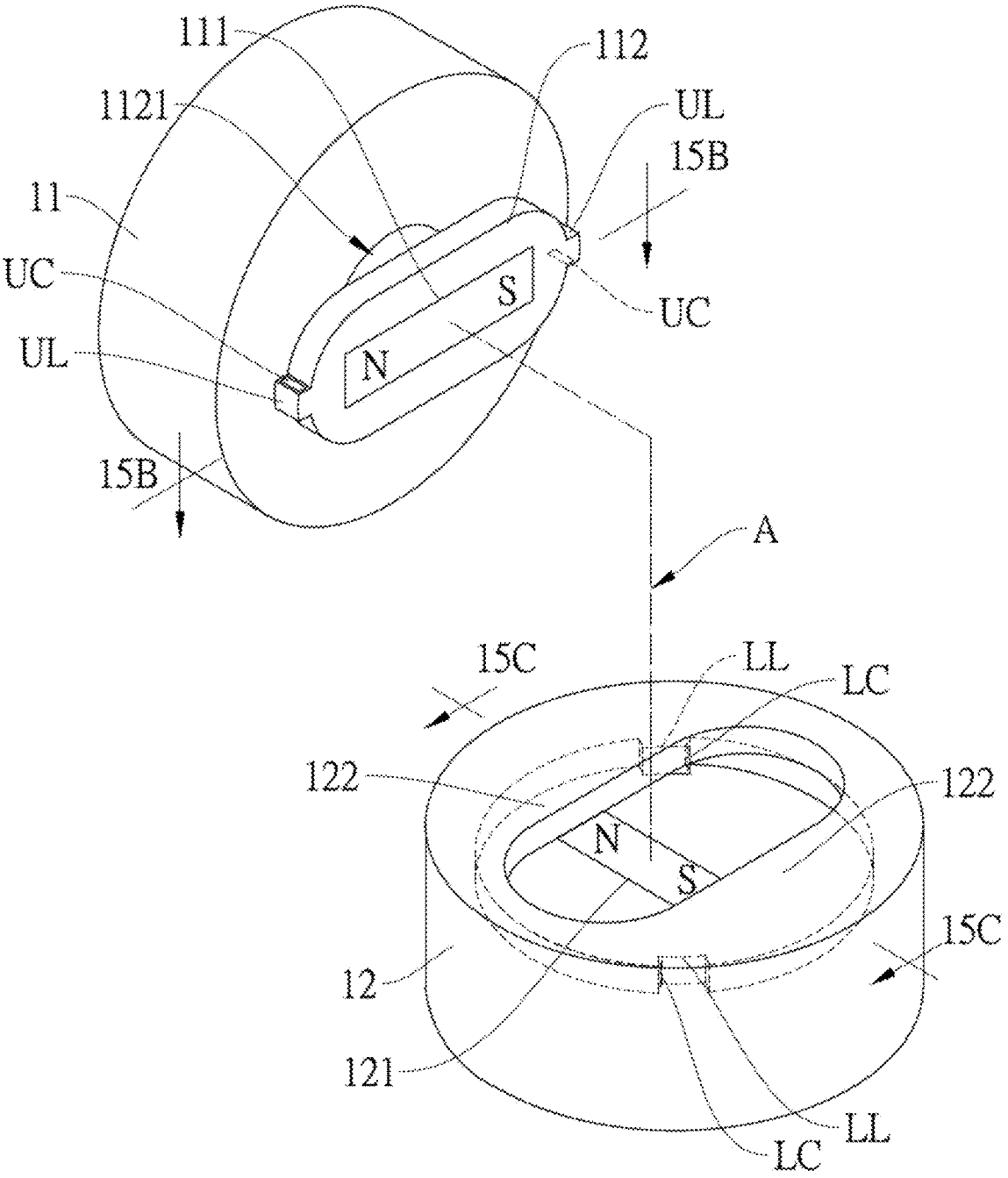
FIG. 15A is an explosive diagram of a magnetic assembly structure according to a seventh embodiment of the present disclosure.
Figure 15B:
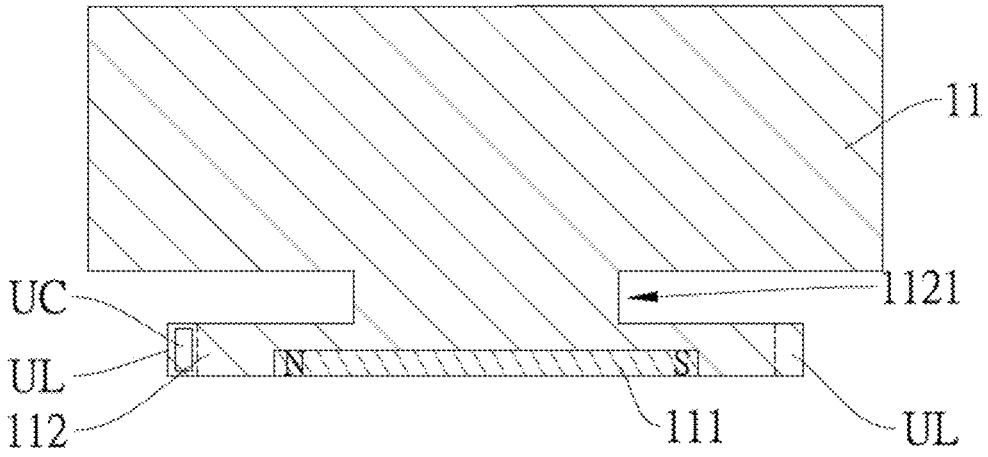
FIG. 15B is sectional view a first main body of FIG. 15A of a line 15B-15B.
Figure 15C:
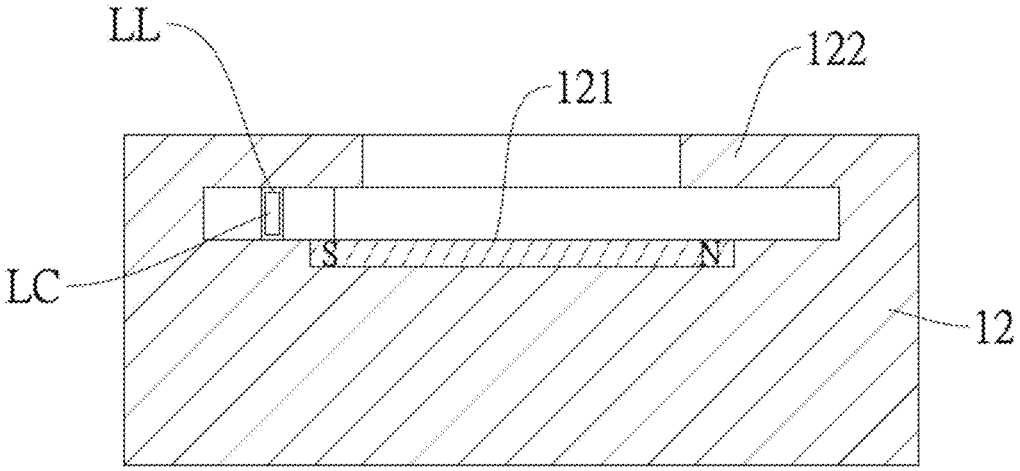
FIG. 15C is sectional view a second main body of FIG. 15A of a line 15C-15C.
Figure 15D:
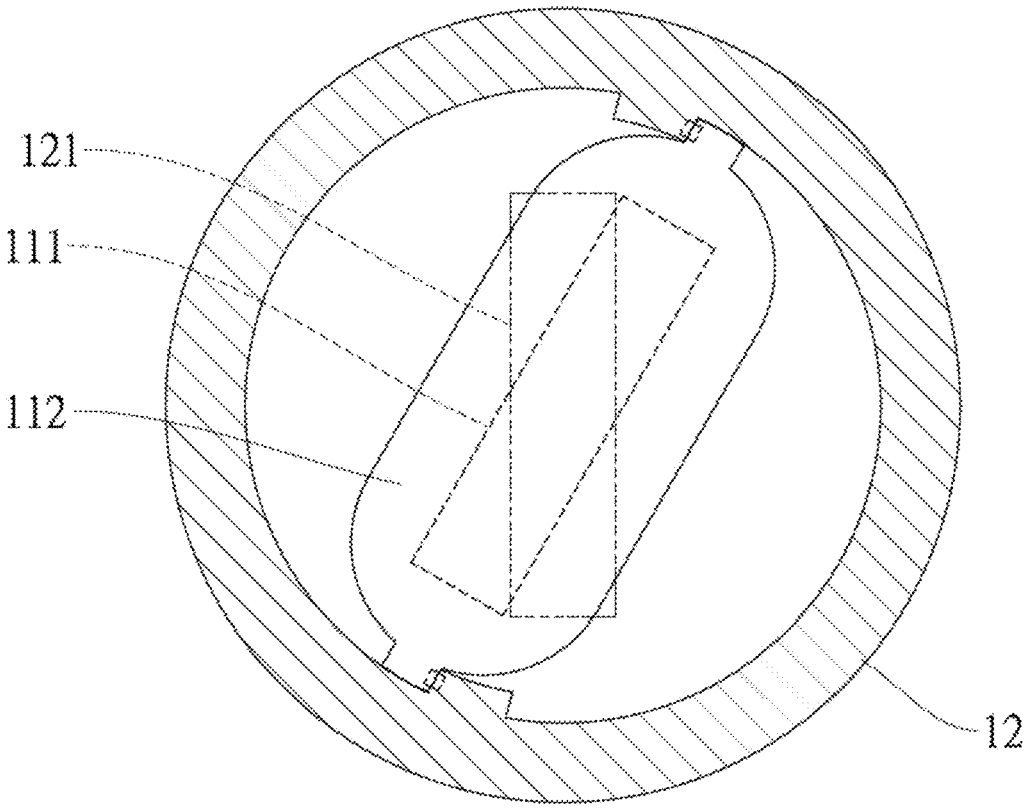
FIG. 15D is a top view schematic diagram showing the first main body and second main body of FIG. 15A mutually close.

Referring to FIG. 6A through FIG. 7B again, when the user begin to make the first main body (11) and the second main body (12) mutually close, the operation principle and manner are the same as those of the first embodiment, thus omitting the redundant descriptions. The first main body (11) and the second main body (12) are mutually and automatically rotated due to the magnetic attraction effect generated by the N pole of the first magnetic component (111) and the S pole of the second magnetic component (121), for example, the second buckle structure (122) (or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other.

Next, referring to FIG. 8, FIG. 9A, FIG. 9B, FIG. 10A and FIG. 10B, which illustrate a third embodiment of the magnetic assembly structure of the present disclosure, the third embodiment is similar to the first embodiment, and the differences of the two embodiments are illustrated as follows. The second buckle structure (122) of the second main body (12) in the third embodiment is disposed on one of the front and back sides of the second magnetic component (121), or the second buckle structure (122) is disposed on one of the front and back sides of the second magnetic axis (1211). When the user begin to make the first main body (11) and the second main body (12) mutually close, the second buckle structure (122) penetrates the notch (1122) and is disposed at the tail terminal of the groove (1121), and the first magnetic component (111) and the second magnetic component (121) are parallel to each other, or the N pole direction of the first magnetic component (111) and the N pole direction of the magnetic component (121) are intersected to form a repulsion angle (not shown in the drawings). Meanwhile, no force is needed to rotate the first main body (11) or the second main body (12), the first main body (11) or the second main body (12) are rotated in respect to the rotation axis (A) due to the magnetic repulsion effect generated by the N poles (or S poles) of the first magnetic component (111) and the second magnetic component (121), for example, the second buckle structure (122) (i.e. or the protrusion block) is automatically moved forward interior of the groove (1121) from the tail terminal of the groove (1121). Therefore, the protrusion block is engaged to the groove (1121), and the first buckle structure (112) and the second buckle structure (122) are engaged to each other. The repulsion angle can be larger than or equal to 0 degree, and preferably, the repulsion angle is equal to 0 degree.

Referring to FIG. 11A, FIG. 11B, FIG. 12A and FIG. 12B, which illustrate a fourth embodiment of the magnetic assembly structure of the present disclosure, the fourth embodiment is similar to the second embodiment, and the differences of the two embodiments are illustrated as follows. The two first magnetic components (111) in the fourth embodiment are poles of same polarities, for example, both of them are the N poles or the S poles, and the two second magnetic components (121) are poles of same polarities, wherein the polarity of the pole of the first magnetic component (111) is the same as that of the second magnetic component (121).

In addition, the first buckle structure (112) is further disposed on a top side edge of the first magnetic component (111), and the second buckle structure (122) is further disposed on a top side edge of the second magnetic component (121). When the first buckle structure (112) and the second buckle structure (122) are engaged to each other, the first buckle structure (112) and the second buckle structure (122) are disposed on the top side edges of the first magnetic component (111) and the second magnetic component (121). Further, in one other embodiment, the first buckle structure (112) can be disposed on the bottom side edge of the first magnetic component (111), and the second buckle structure (122) can be disposed on the bottom side edge of the second magnetic component (121). When the first buckle structure (112) and the second buckle structure (122) are engaged to each other, the first buckle structure (112) and the second buckle structure (122) are disposed on the bottom side edges of the first magnetic component (111) and the second magnetic component (121).

Based on the above first through fourth embodiments, the first magnetic component (111) and the second magnetic component (121) of the magnetic assembly structure of the present disclosure can mutually generate the magnetic attraction or repulsion effect, so as to rotate the second main body (12) and the first main body (11) in respect to each other. Therefore, the second buckle structure (122) and the first buckle structure (112) can be engaged to each other.

Based on the above first through fourth embodiments, a fifth embodiment is also provided. The differences of the fifth embodiment and the first through fourth embodiments are illustrated as follows. The second buckle structure (122) of the fifth embodiment is a magnetic component, and the magnetic component is a magnet or an iron product. Thus, the magnetic component (111) and the second buckle structure (122) mutually generate the magnetic attraction or repulsion effect, so as to rotate the second main body (12) and the first main body (11) in respect to each other. Therefore, the second buckle structure (122) and the first buckle structure (112) can be engaged to each other.

Based upon the above fifth embodiment, a sixth embodiment is also provided. The differences of the sixth embodiment and the fifth embodiment are illustrated as follows. The first buckle structure (112) is another magnetic component. Thus, the first buckle structure (112) and the second buckle structure (122) mutually generate the magnetic attraction or repulsion effect, so as to rotate the second main body (12) and the first main body (11) in respect to each other. Therefore, the second buckle structure (122) and the first buckle structure (112) can be engaged to each other.

Refer to FIG. 13A through FIG. 13D, which respectively are an explosive diagram of a magnetic assembly structure according to a fifth embodiment of the present disclosure, a sectional view a first main body of a line 13B-13B, a sectional view a second main body of a line 13C-13C, a sectional diagram showing the first main body and second main body mutually close. In the embodiment, the first buckle structure (112) is a flange, a top part of the first buckle structure (112) is formed with a groove (1121), and the second buckle structure (122) is a bump. When the user uses his/her hand to place the second buckle structure (122) of the second main body (12) to the groove (1121), since the first main body (11) and the second main body (12) mutually generate a magnetic attraction or repulsion effect to automatically rotate the second main body (12) and first main body (11) in respect to each other, the bump is able to move in the groove (1121). Thus, the second buckle structure (122) automatically moves from one end of the groove (1121) to interior of the groove (1121), i.e. another end of the groove (1121), thereby engaging the bump and the groove (1121) and engaging the second buckle structure (122) and the first buckle structure (112).

In the embodiment, the first main body (11) has at least one upper conductive point (UC), and the second main body (12) has at least one lower conductive point (LC). The upper conductive point (UC) is disposed on an inner side of the first buckle structure (112), and the lower conductive point (LC) is disposed under an inner side of the second buckle structure (122). The disposing position of the upper conductive point (UC) is corresponding to the disposing position of the lower conductive point (LC). After the second buckle structure (122) and the first buckle structure (112) are engaged to each other, the upper conductive point (UC) and the lower conductive point (LC) contact and conduct each other. That is, after the second main body (12) and first main body (11) automatically rotate in respect to each other, and the bump and the groove (1121) are engaged with each other, the upper conductive point (UC) and the lower conductive point (LC) contact and conduct each other. In the embodiment, the numbers of the upper conductive points (UC) and the lower conductive points (LC) are respectively two, for example, corresponding positive power conductive pads and corresponding negative power conductive pads. Further, by using the disposing configuration of the upper conductive points (UC) and lower conductive points (LC), it can prevent the user from directly the upper conductive points (UC) and lower conductive points (LC), and the electric shock problem can be solved, or it can achieve the effect of protecting the upper conductive points (UC) and lower conductive points (LC).

It is noted that, the numbers of the upper conductive points (UC) and the lower conductive points (LC) are not used to limit the present disclosure, and can be determined or designed according to the actual requirements. The types of the upper conductive points (UC) and the lower conductive points (LC) are not used to limit the present disclosure, and in addition to the positive and negative power conductive pads, they can be positive and negative power conductive terminals, positive and negative power conductive blade sheets, positive and negative power conductive elastic sheets, signal transmission conductive terminals (such as, USB signal transmission or transmission of signals of other types, and the present disclosure is not limited thereto), signal transmission conductive blade sheets, signal transmission conductive elastic sheets or signal transmission conductive pads. The disposing positions of the upper conductive points (UC) and the lower conductive points (LC) are not used to limit the present disclosure, but the upper conductive points (UC) and the lower conductive points (LC) must be disposed corresponding to each other. The upper conductive points (UC) can be disposed in one position of an upper conductive point disposing space (UCS), and the upper conductive point disposing space (UCS) is formed by a surface of the first buckle structure (112) of the first main body (11) and a lower surface of the first main body (11) which faces the first buckle structure (112). The lower conductive points (LC) can be disposed in one position of an lower conductive point disposing space (LCS), and the lower conductive point disposing space (LCS) is formed by a surface of the second buckle structure (122) of the second main body (21) and an upper surface of the second main body (21) which faces the second buckle structure (122).

Refer to FIG. 14A through FIG. 14D, which respectively are an explosive diagram of a magnetic assembly structure according to a sixth embodiment of the present disclosure, a sectional view a first main body of a line 14B-14B, a sectional view a second main body of a line 14C-14C, a 3D sectional diagram showing the first main body and second main body mutually close. Compared to the fifth embodiment, in the embodiment, the first main body (11) further has at least one upper limit part (UL), and the second main body further has at least one lower limit part (LL) corresponding to the at least one upper limit part (UL).

In the embodiment, the numbers of the upper limit parts (UL) and the lower limit parts (LL) are respectively two. The upper limit parts (UL) are disposed on two sides of the outer surface of the first buckle structure (112), and the lower limit parts (LL) are disposed on two sides of the inner surface of the second buckle structure (122). Thus, after the second main body (12) and first main body (11) automatically rotate in respect to each other, the upper limit part (UL) and the lower limit part (LL) engage to each other to achieve an limit effect, and thus the upper conductive point (UC) and the lower conductive point (LC) contact and conduct each other. Simply speaking, to avoid the the upper conductive point (UC) and the lower conductive point (LC) do not contact and conduct each other stably and efficiently, the installation of the upper limit part (UL) and the lower limit part (LL) can further help the limit of the upper conductive point (UC) and the lower conductive point (LC) after the second main body (12) and first main body (11) automatically rotate in respect to each other.

It is noted that the numbers of the of the upper limit parts (UL) and the lower limit parts (LL) are not used to limit the present disclosure, and the disposing positions of the upper limit parts (UL) and the lower limit parts (LL) are not used to limit the present disclosure, but the upper limit parts (UL) and the lower limit parts (LL) must be disposed corresponding to each other, that is, after the second main body (12) and first main body (11) automatically rotate in respect to each other, the upper limit parts (UL) and the lower limit parts (LL) are engaged to each other to achieve the limit effect. The upper limit parts (UL) can be disposed in one position of an upper limit part disposing space (ULS), and the upper limit part disposing space (ULS) is formed by a surface of the first buckle structure (112) of the first main body (11) and a lower surface of the first main body (11) which faces the first buckle structure (112). The lower limit parts (LL) can be disposed in one position of an lower limit part disposing space (LLS), and the lower limit part disposing space (LLS) is formed by a surface of the second buckle structure (122) of the second main body (12) and an upper surface of the second main body (12) which faces the second buckle structure (122). It is noted that, the upper limit part (UL) and the corresponding lower limit part (LL) can be two bumps, one bump and one slot, or one elastic pin and one hole, and generally, the types of the types of the upper limit part (UL) and the corresponding lower limit part (LL) are not used to limit the present disclosure.

Refer to FIG. 15A through FIG. 15D, which respectively are an explosive diagram of a magnetic assembly structure according to a sixth embodiment of the present disclosure, a sectional view a first main body of a line 15B-15B, a sectional view a second main body of a line 15C-15C, a top view schematic diagram showing the first main body and second main body mutually close. Being different from the sixth embodiment, in the embodiment, the upper conductive point (UC) is directly disposed on the upper limit part (UL), and the lower conductive point (LC) is directly disposed on the lower limit part (LL). When the upper limit part (UL) and the lower limit part (LL) are engaged to each other, the upper conductive point (UC) and the lower conductive point (LC) contact and conduct each other.

Figure 16A:
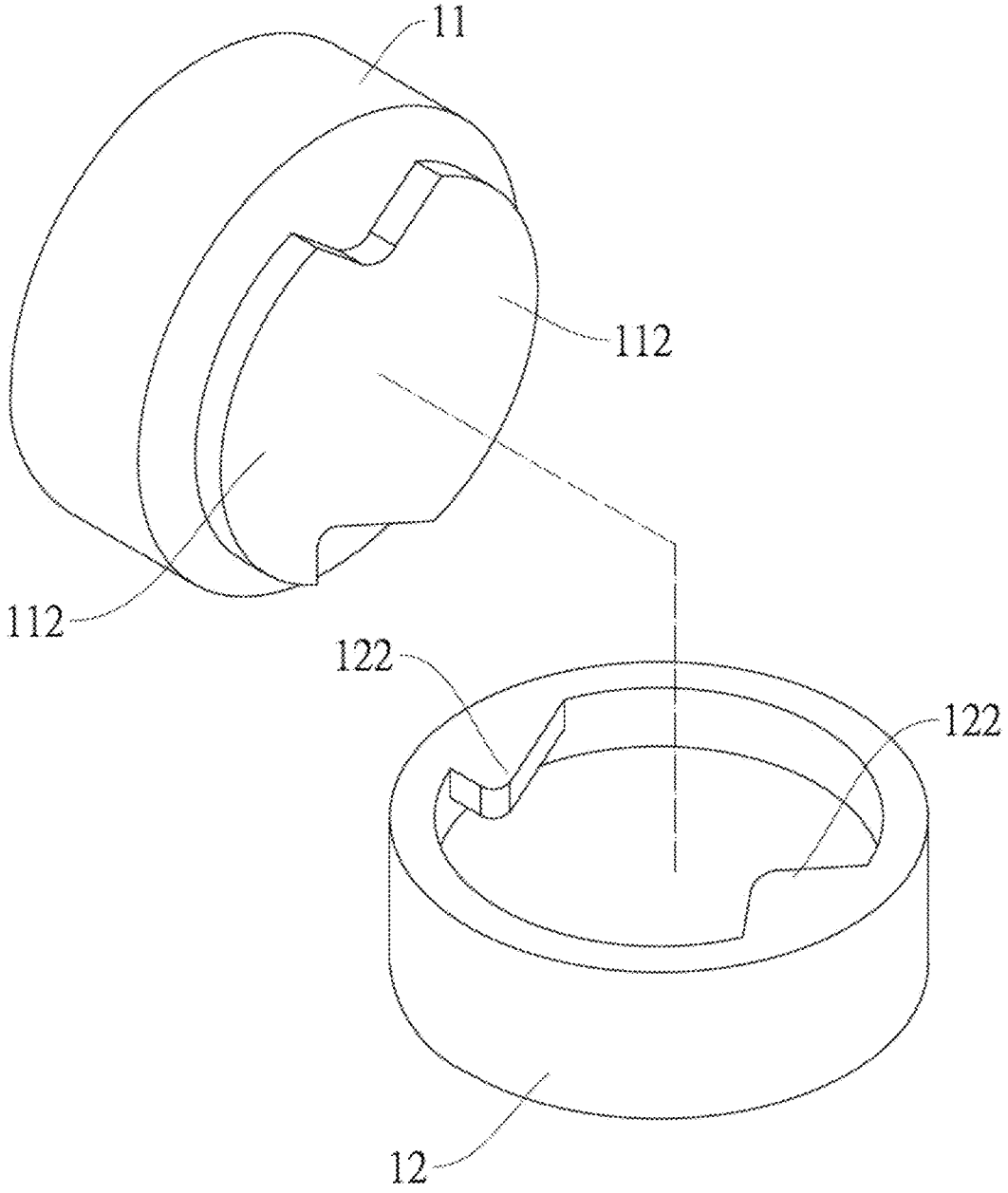
FIG. 16A is an explosive diagram of a magnetic assembly structure according to an eighth embodiment of the present disclosure.
Figure 16B:
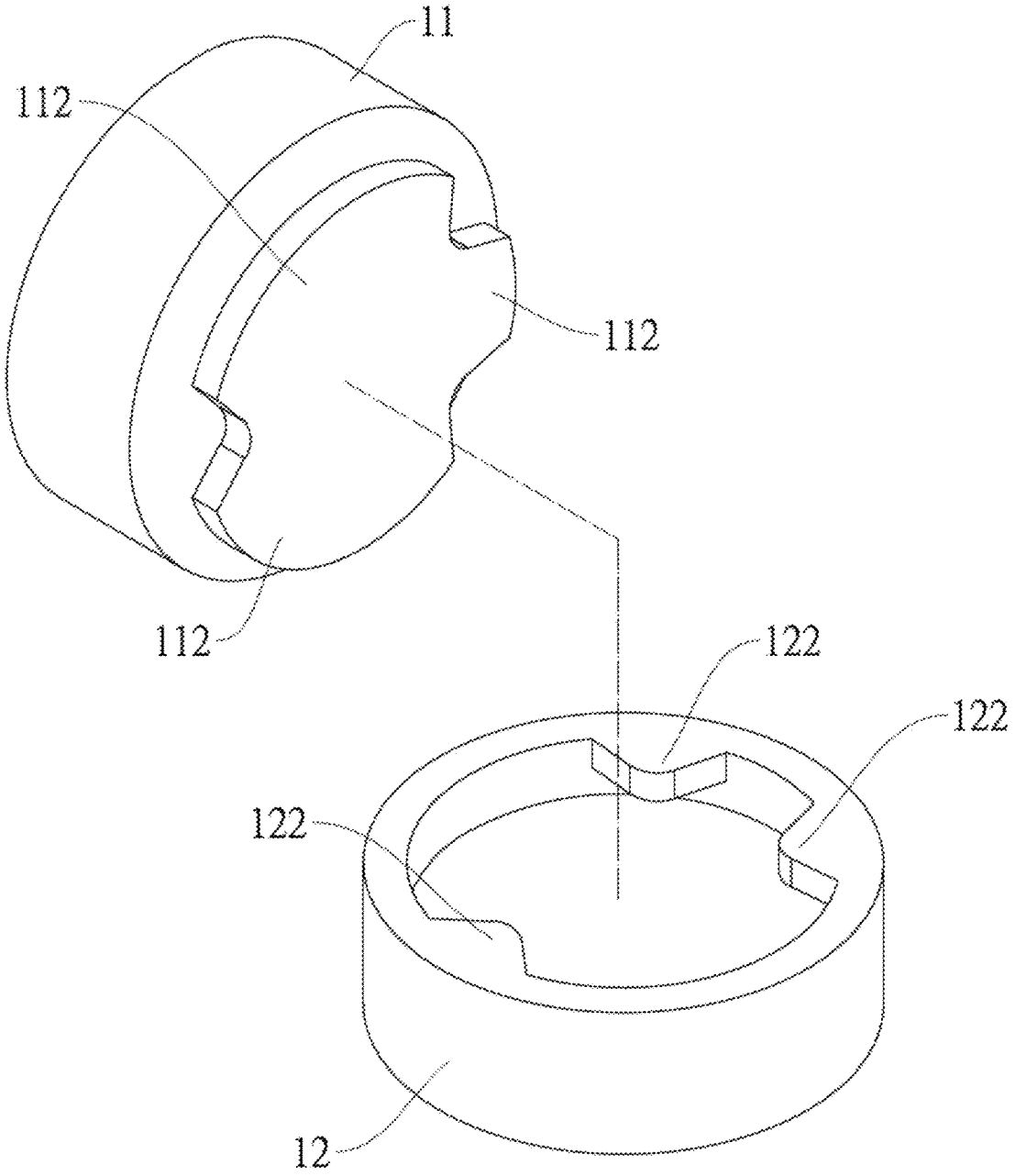
FIG. 16B is an explosive diagram of a magnetic assembly structure according to a ninth embodiment of the present disclosure.

Referring to FIGS. 16A and 16B, which respectively are explosive diagrams of magnetic assembly structures according to an eighth and ninth embodiments of the present disclosure. Being different the above embodiments, in the eighth and ninth embodiments, the shapes, dimensions and/or disposing positions of the first buckle structures (112) are not symmetrical, and the shapes, dimensions and/or disposing positions of the second buckle structures (122) are not symmetrical. Thus, it can avoid the user mistakenly install the second body (12) to the first main body (11), and thus that the upper conductive point mistakenly conducts to the non-corresponding lower conductive point can be prevented, such that the danger or the damage of the electronic component in the magnetic assembly structure can be avoided.

Simply speaking, the configuration in the above embodiments is to achieve foolproof effect, and to make sure only the upper conductive point and the corresponding lower conductive point conduct each other.

It is noted that the disposing positions of the first buckle structures (112) are not symmetrical means the first buckle structures (112) are asymmetrically disposed on a circumference formed by a center point (i.e. circle center) of the first main body (11), and a central angle of the two adjacent first buckle structures (112) in respect to the center point of the first main body (11) is not 360/N degrees, wherein N is the number of the first buckle structures (112). Similarly, that the disposing positions of the second buckle structures (122) are not symmetrical means the second buckle structures (122) are asymmetrically disposed on a circumference formed by a center point (i.e. circle center) of the second main body (12), and a central angle of the two adjacent second buckle structures (122) in respect to the center point of the second main body (12) is not 360/M degrees, wherein M is the number of the second buckle structures (122), and M is equal to N.

To put it concretely, in the embodiment of FIG. 16A, the numbers of the first buckle structures (112) and the second buckle structures (122) are two, and the shapes of the first buckle structures (112) and the second buckle structures (122) not symmetrical, but the shapes of the first buckle structures (112) and the second buckle structures (122) are corresponding to each other. In the embodiment of FIG. 16B, the numbers of the first buckle structures (112) and the second buckle structures (122) are three, and the disposing positions of the first buckle structures (112) and the second buckle structures (122) not symmetrical, but the disposing positions of the first buckle structures (112) and the second buckle structures (122) are corresponding to each other, wherein take the center point of the first main body (11) as a reference point, the angle between the disposing positions of any two first buckle structures (112) is not 120 degrees (360/3 degrees), and take the center point of the second main body (12) as a reference point, the angle between the disposing positions of any two second buckle structures (122) is not 120 degrees (360/3 degrees). For example, one angle between the disposing positions of the two first buckle structures (112) is 60 degrees, and other two angles between the disposing positions of the each two first buckle structures (112) are 150 degrees; one angle between the disposing positions of the two second buckle structures (122) is 60 degrees, and other two angles between the disposing positions of the each two second buckle structures (122) are 150 degrees.

It is noted that, the numbers of the first buckle structures (112) and the second buckle structures (122) are not used to limit the present disclosure, for example, the numbers of the first buckle structures (112) and the second buckle structures (122) in the fifth through eighth embodiments are two, but in the numbers of the first buckle structures (112) and the second buckle structures (122) in the ninth embodiment is three.

Figure 17:
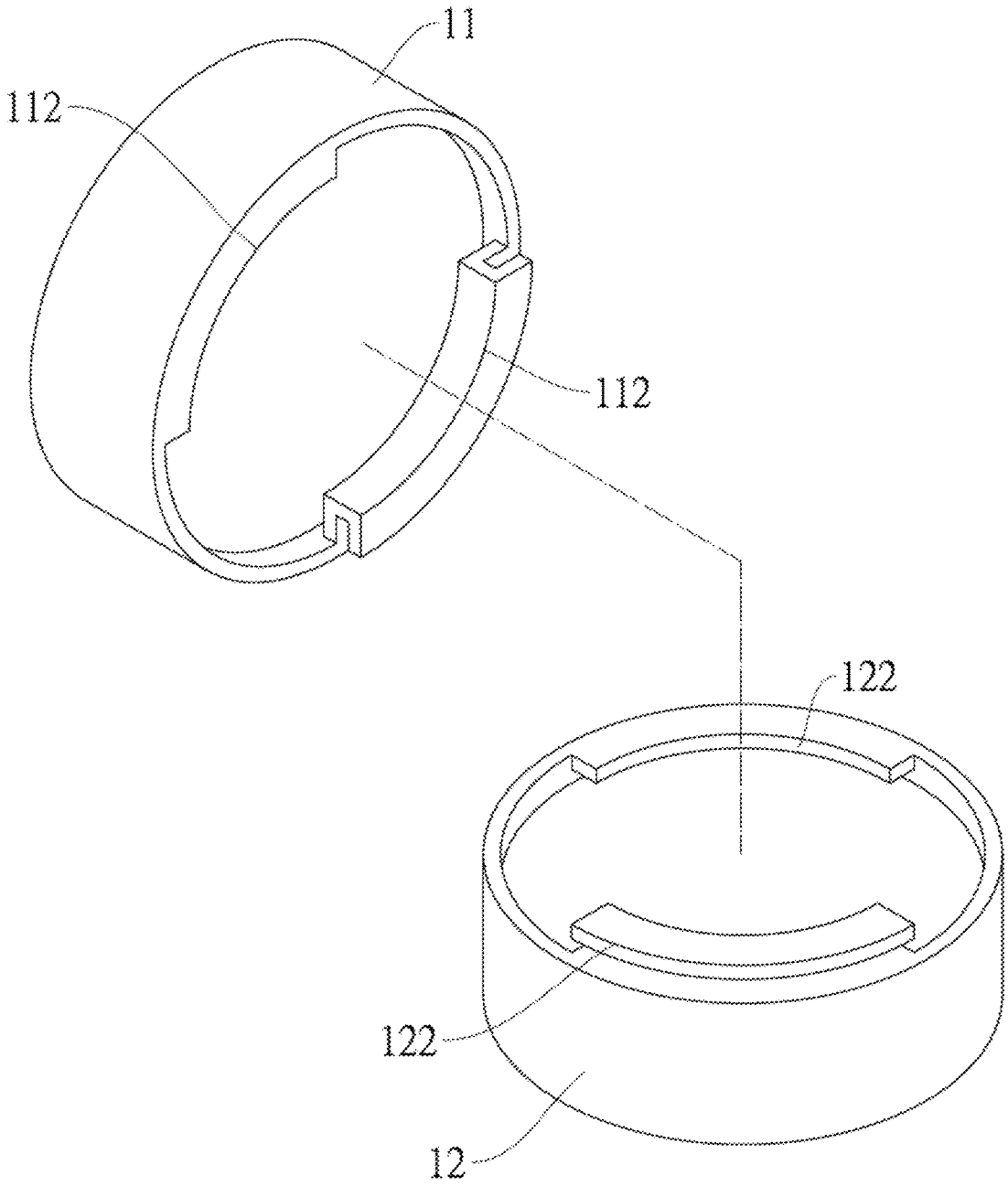
FIG. 17 is an explosive diagram of a magnetic assembly structure according to a tenth embodiment of the present disclosure.

Referring to FIG. 17, which is an explosive diagram of a magnetic assembly structure according to a tenth embodiment of the present disclosure. Being compared to the eighth embodiment, in the embodiment, the shapes of the two first buckle structures (112) are different and their structure is not identical to each other. One of the first buckle structures (112) is a flange and has a groove on its top part, and other one of the first buckle structures (112) is a bump; correspondingly, one of the second buckle structures (122) is a bump, and other one of the second buckle structures (122) is a flange and has a groove on its top part. Thus, it still can achieve the foolproof effect, and make sure the upper and lower conductive points conduct each other.

Figure 18A:
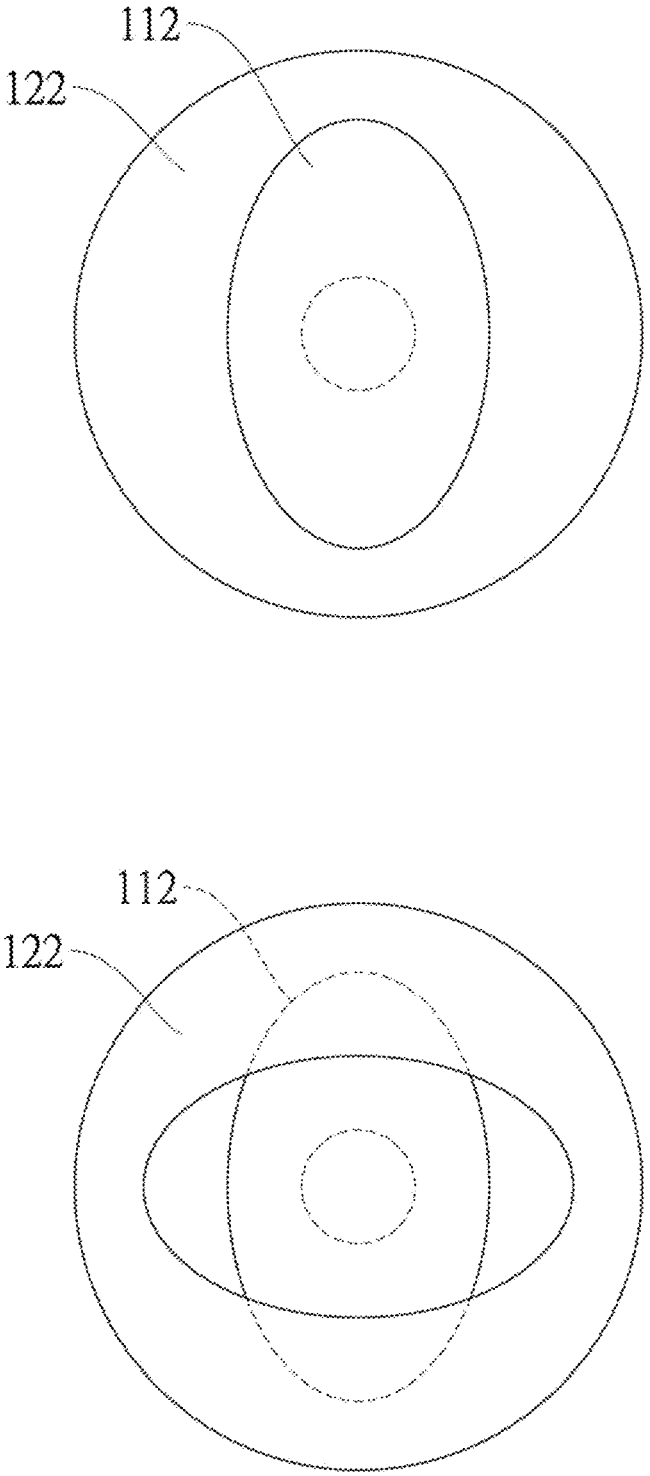
FIG. 18A is a top view schematic diagram showing an operation of the magnetic assembly structure according to an eleventh embodiment of the present disclosure.
Figure 18B:
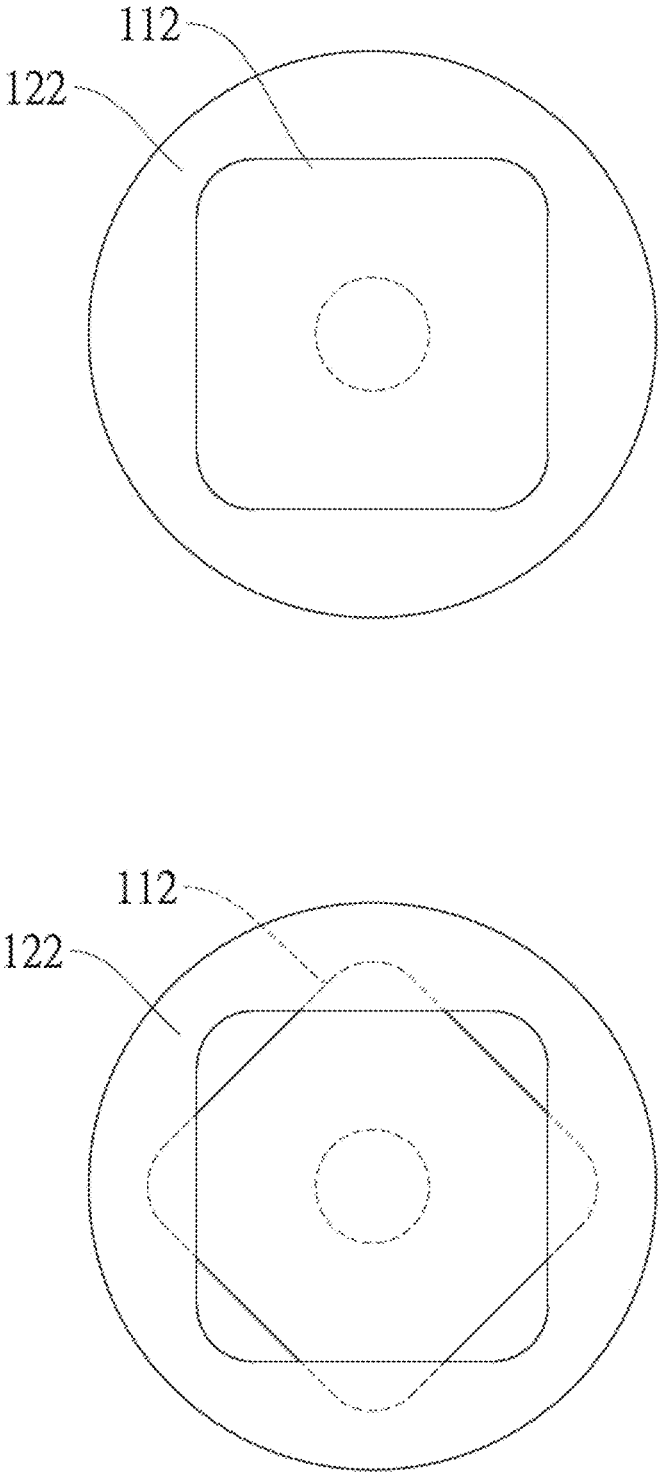
FIG. 18B is a top view schematic diagram showing an operation of the magnetic assembly structure according to a twelfth embodiment of the present disclosure.
Figure 18C:
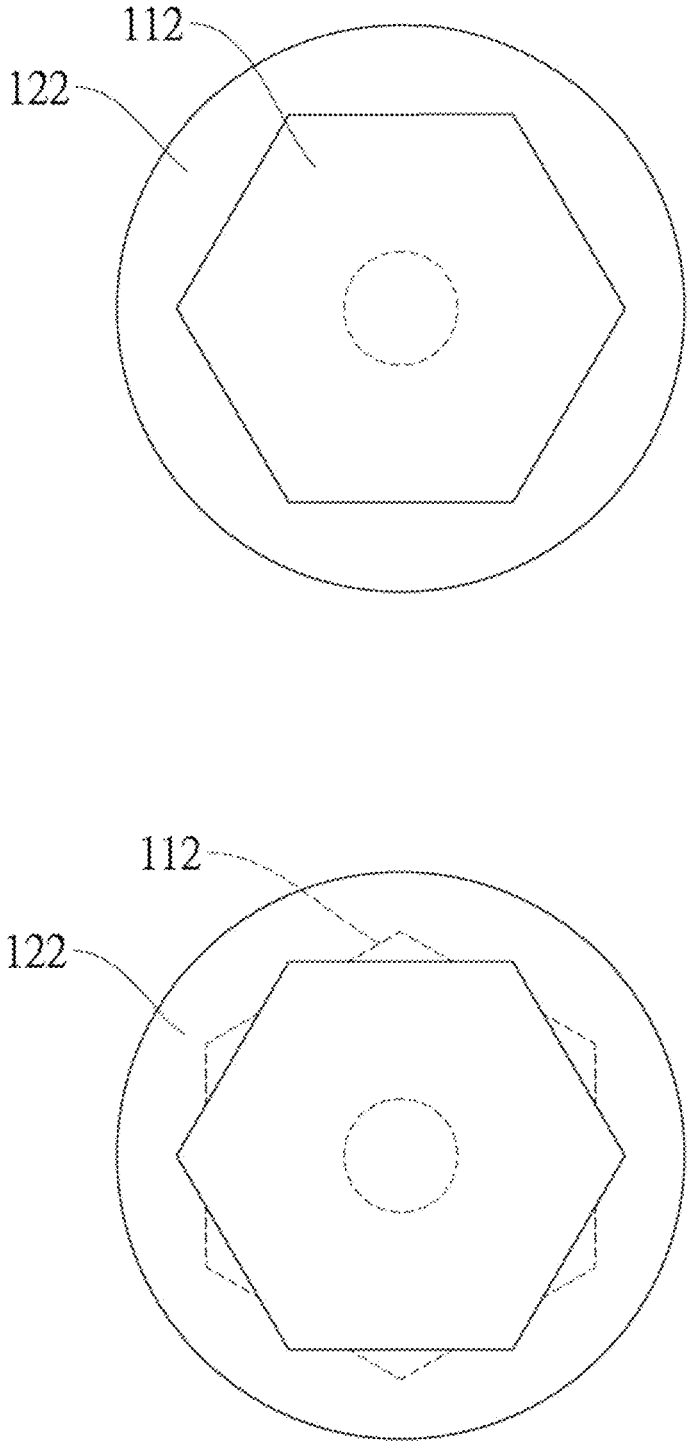
FIG. 18C is a top view schematic diagram showing an operation of the magnetic assembly structure according to a thirteenth embodiment of the present disclosure.

Referring to FIG. 18A through FIG. 18C, which are top view schematic diagrams showing operations of the magnetic assembly structures according to an eleventh through thirteenth embodiments of the present disclosure. The differences between the eleventh through thirteenth embodiments and the fifth embodiments are that the shapes of the first buckle structures (112) in the eleventh through thirteenth embodiments are different from the shape of the first buckle structures (112) in the fifth embodiment, and correspondingly, the shapes of the second buckle structures (122) in the eleventh through thirteenth embodiments are different from the shape of the second buckle structures (122) in the fifth embodiment. Further, the numbers of the first buckle structures (112) and the second buckle structures (122) in the eleventh through thirteenth embodiments are different from the numbers of the first buckle structures (112) and the second buckle structures (122) in the fifth embodiment.

Further, though the shapes formed by the two first buckle structures (112) and the two second buckle structures (122) in the eleventh embodiment are still symmetrical oval structures, but they are not the same as the symmetrical oval structures formed by the two first buckle structures (112) and the two second buckle structures (122) in the fifth embodiment. The shapes formed by the four first buckle structures (112) and the four second buckle structures (122) in the twelfth embodiment are symmetrical rounded square structures, and the shapes formed by the six first buckle structures (112) and the six second buckle structures (122) in the thirteenth embodiment are symmetrical hexagonal structures.

The shapes, dimensions and/or disposing positions of the first buckle structures (112) in the eleventh through thirteen embodiments are symmetrical, and the shapes, dimensions and/or disposing positions of the second buckle structures (122) in the eleventh through thirteen embodiments are symmetrical. That the disposing positions of the first buckle structures (112) are symmetrical means the first buckle structures (112) are symmetrically disposed on a circumference formed by a center point (i.e. circle center) of the first main body (11), and a central angle of the two adjacent first buckle structures (112) in respect to the center point of the first main body (11) is 360/N degrees, wherein N is the number of the first buckle structures (112). Similarly, that the disposing positions of the second buckle structures (122) are symmetrical means the second buckle structures (122) are symmetrically disposed on a circumference formed by a center point (i.e. circle center) of the second main body (12), and a central angle of the two adjacent second buckle structures (122) in respect to the center point of the second main body (12) is 360/M degrees, wherein M is the number of the second buckle structures (122), and M is equal to N.

Figure 18D:
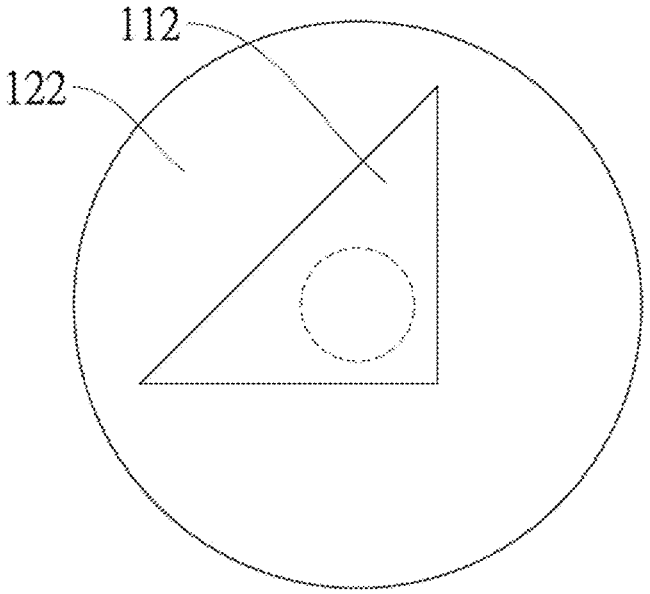
FIG. 18D is a top view schematic diagram showing an operation of the magnetic assembly structure according to a fourteenth embodiment of the present disclosure.
Figure 18D:
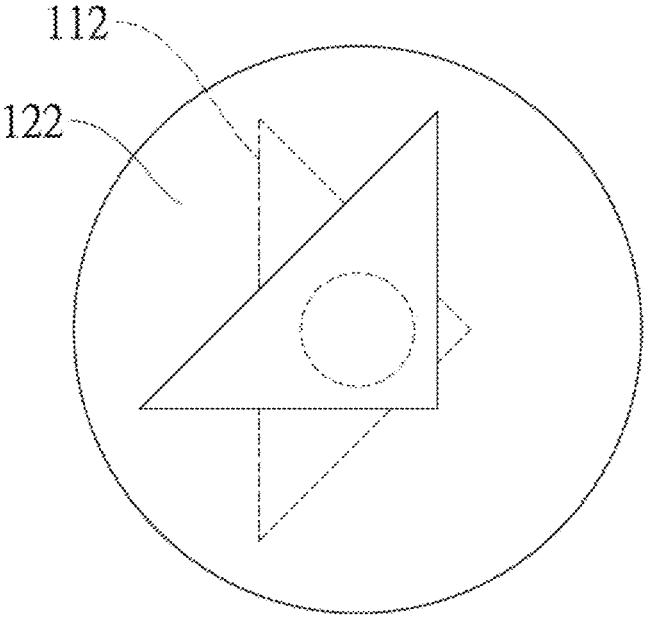

Referring to FIG. 18D, which is a top view schematic diagram showing an operation of the magnetic assembly structure according to a fourteenth embodiment of the present disclosure. The shapes formed by the three first buckle structures (112) and the three second buckle structures (122) are right triangle structures. In other words, disposing positions of the three first buckle structures (112) and the three second buckle structures (122) are not symmetrical, and thus it can make the magnetic assembly structure has the foolproof effect, and make sure the upper conductive point and the corresponding lower conductive point conduct to each other.

Referring to FIG. 19A through FIG. 19D, which respectively are an explosive diagram of a magnetic assembly structure according to a fifteenth embodiment of the present disclosure, a sectional view a first main body of a line 19B-19B, a sectional view a second main body of a line 19C-19C, a sectional diagram showing the first main body and second main body mutually close. In the fifth embodiment, after the second buckle structure (122) moves from end of the groove (1121) to interior of the of the groove (1121) to be limited is a specific position, the first magnetic component (111) and the second magnetic component (121) are not entirely overlapped, and they have an angle, i.e. they are configured to a non-vertical arrangement status. In addition, the first main body (11) has multiple upper conductive points (UC) placed on the same radius of the center point of the first main body (11), but the distances between the upper conductive points (UC) and the center point of the first main body (11) are different from each other. The second main body (12) has multiple lower conductive points (LC) placed on the same radius of the center point of the second main body (12), but the distances between the lower conductive points (LC) and the center point of the second main body (12) are different from each other. By using the above configuration, it can prevent the upper conductive point (UC) from conducting the non-corresponding lower conductive point (LC), and the danger can be avoided.

Figure 19A:
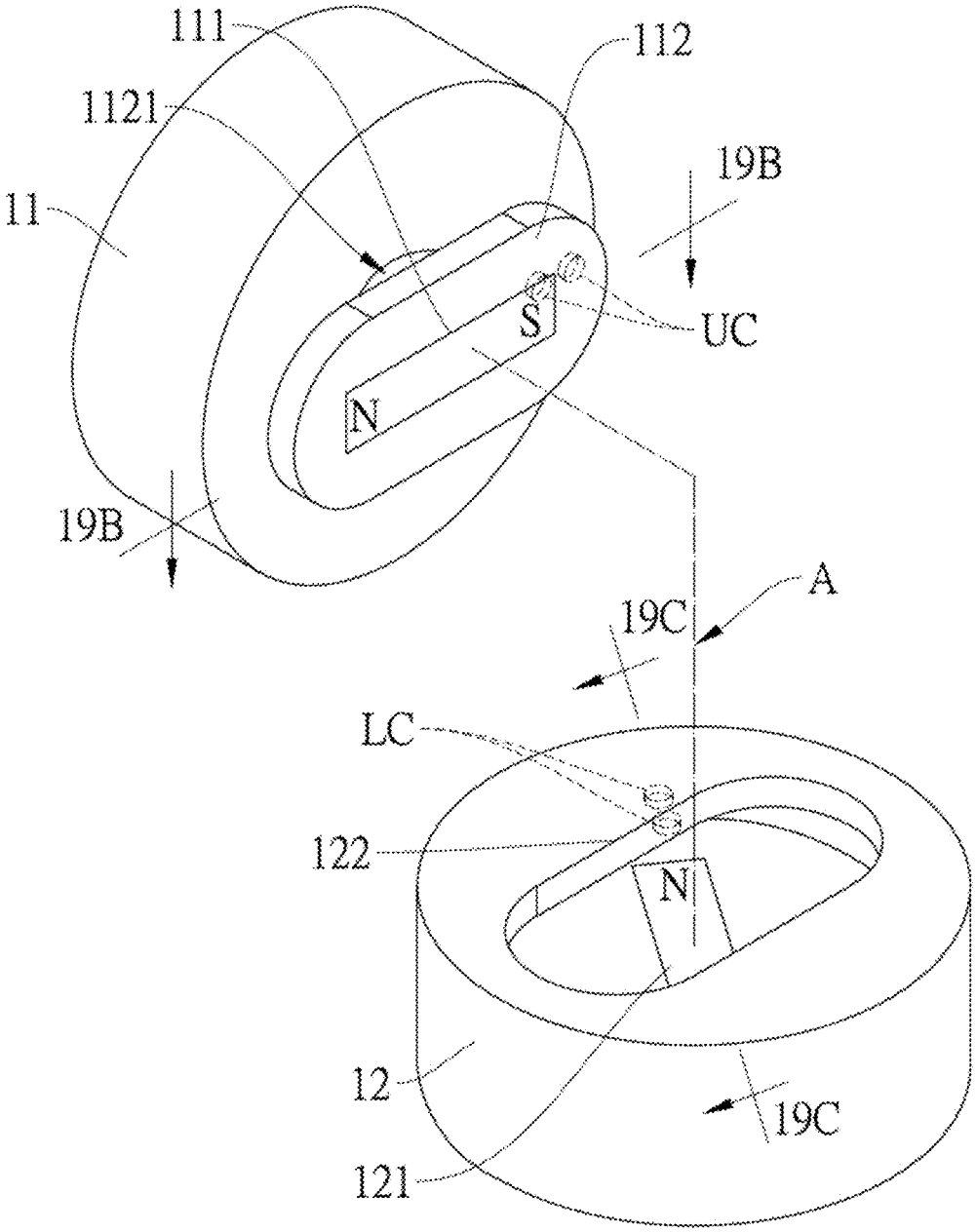
FIG. 19A is an explosive diagram of a magnetic assembly structure according to a fifteenth embodiment of the present disclosure.
Figure 19B:
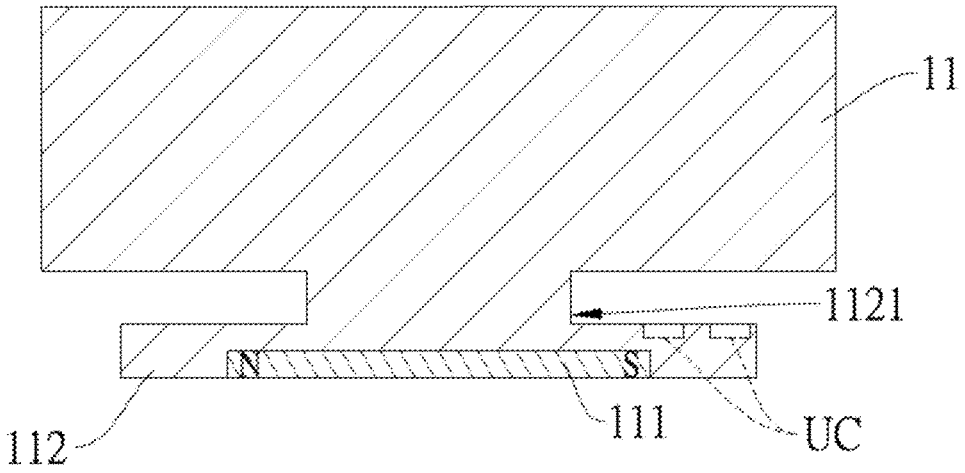
FIG. 19B is sectional view a first main body of FIG. 19A of a line 19B-19B.
Figure 19C:
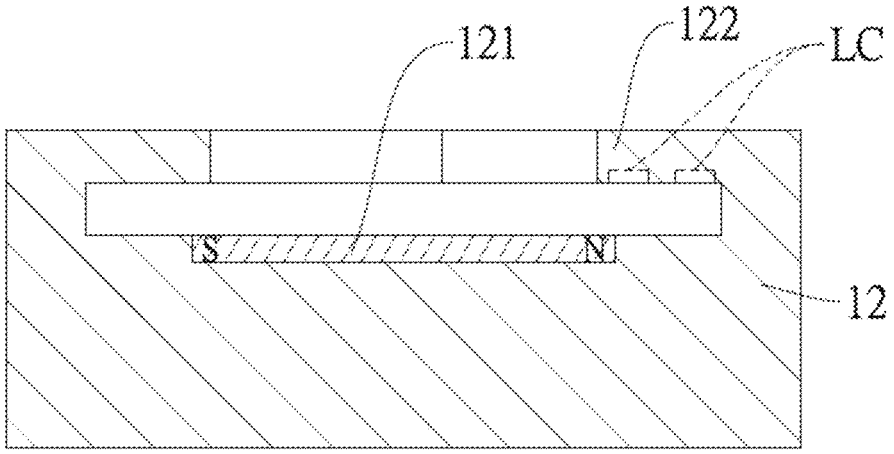
FIG. 19C is sectional view a second main body of FIG. 19A of a line 19C-19C.
Figure 19D:
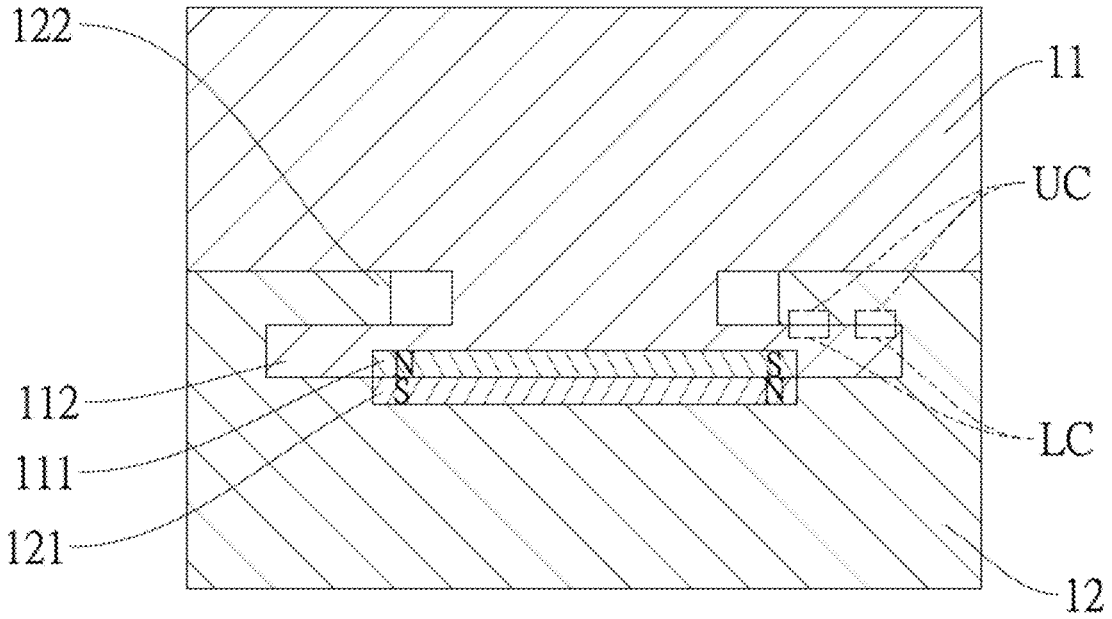
FIG. 19D is a sectional diagram showing the first main body and second main body of FIG. 19A mutually close.
Figure 19E:
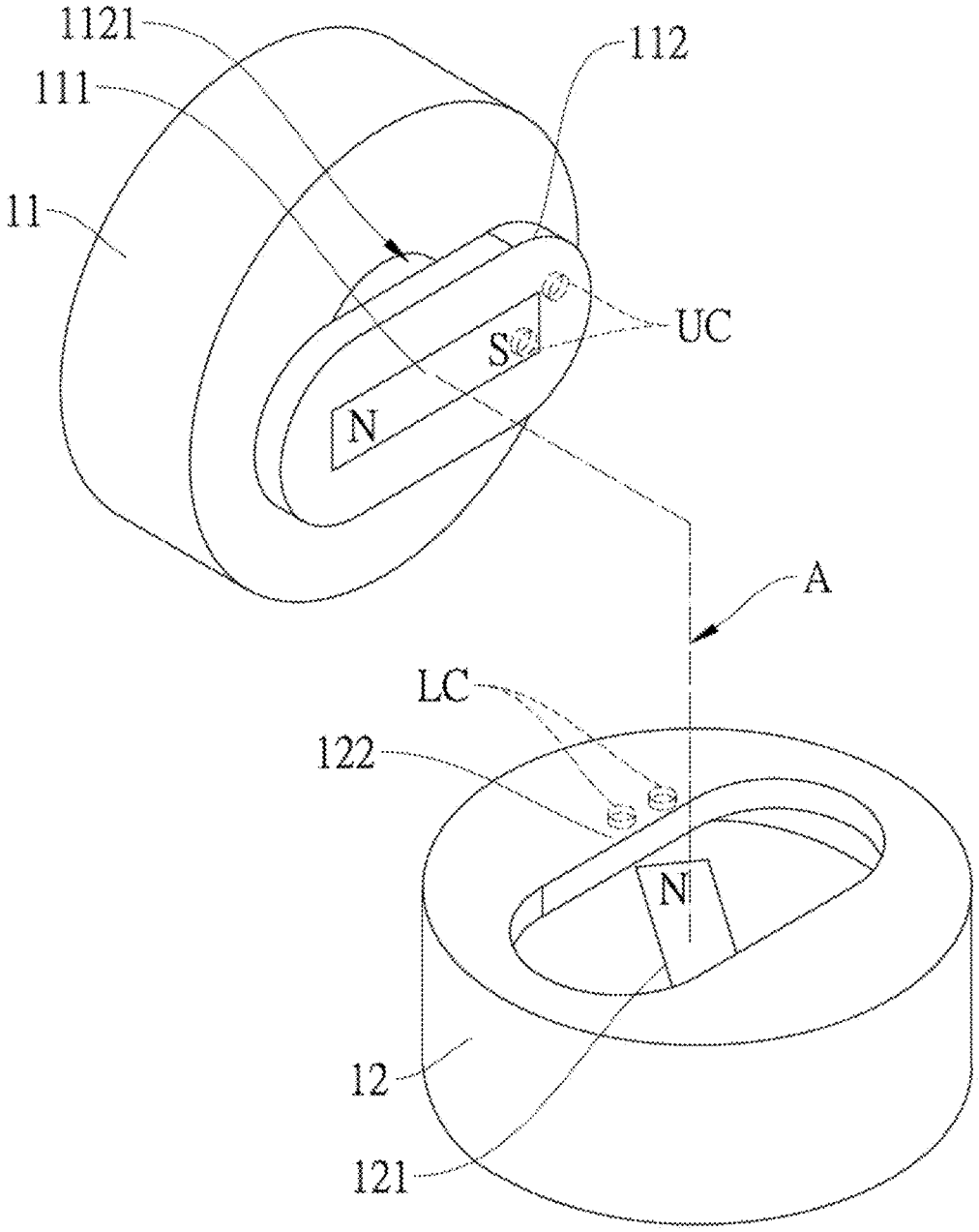
FIG. 19E is an explosive diagram of a magnetic assembly structure according to a sixteenth embodiment of the present disclosure.

Refer to FIG. 19E, which is an explosive diagram of a magnetic assembly structure according to a sixteenth embodiment of the present disclosure. The first main body (11) has multiple conductive points (UC) placed on different radiuses of the center point of the first main body (11), and the distances between the upper conductive points (UC) and the center point of the first main body (11) are different from each other. The second main body (12) has multiple lower conductive points (LC) placed on the different radiuses of the center point of the second main body (12), and the distances between the lower conductive points (LC) and the center point of the second main body (12) are different from each other. By using the above configuration, it can prevent the upper conductive point (UC) from conducting the non-corresponding lower conductive point (LC), and the danger can be avoided.

Figure 20:
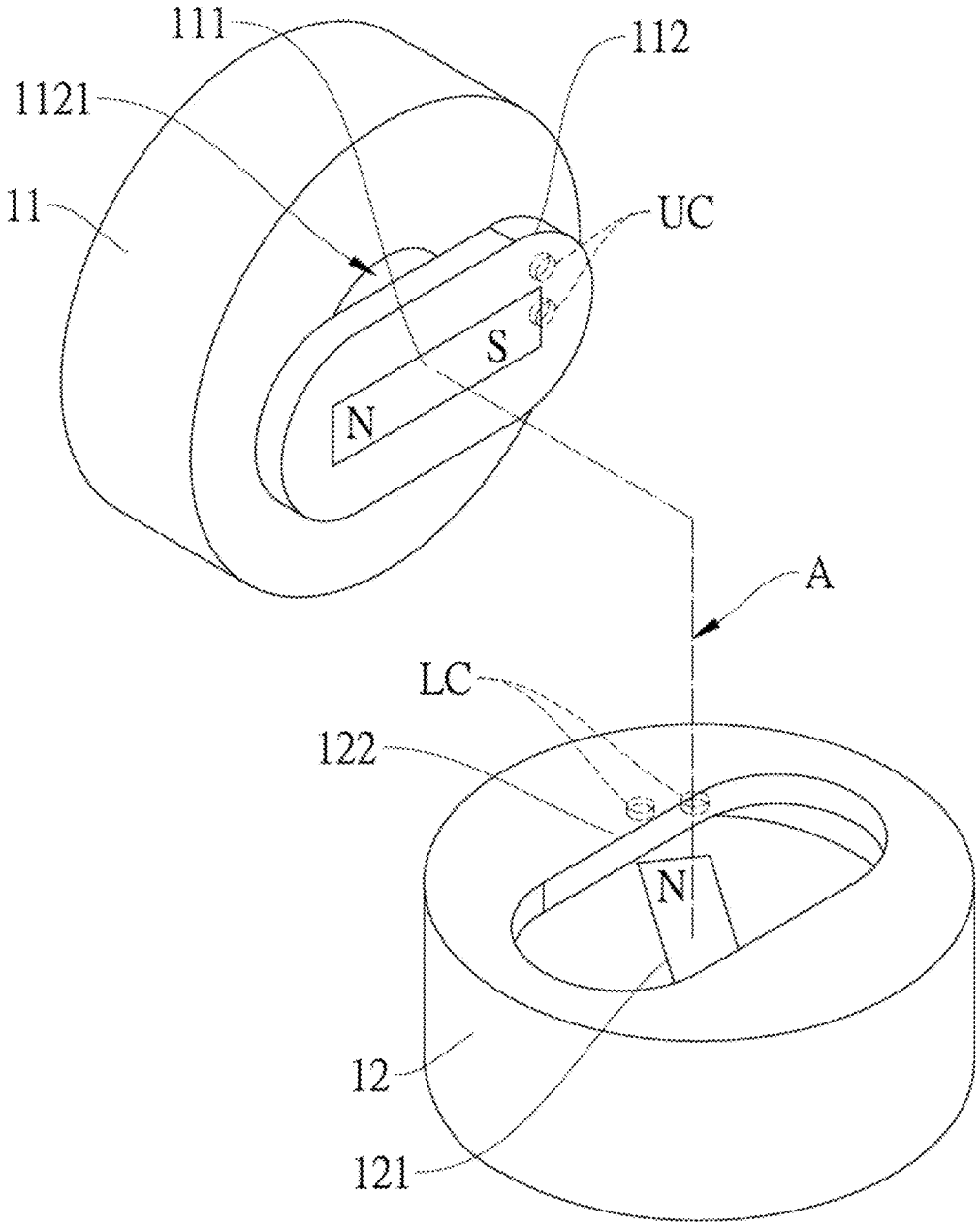
FIG. 20 is an explosive diagram of a magnetic assembly structure according to a seventeenth embodiment of the present disclosure.

Refer to FIG. 20, which is an explosive diagram of a magnetic assembly structure according to a seventeenth embodiment of the present disclosure. Being different from the fifteenth embodiment, in the seventeenth embodiment, the first main body (11) has multiple upper conductive points (UC) placed on the different radiuses of the center point of the first main body (11), but the distances between the upper conductive points (UC) and the center point of the first main body (11) are identical to each other. The second main body (12) has multiple lower conductive points (LC) placed on the different radiuses of the center point of the second main body (12), but the distances between the lower conductive points (LC) and the center point of the second main body (12) are identical to each other. That is, the upper conductive points (UC) disposed on the same circumference formed by the center point of the first main body (11), and each adjacent two of the upper conductive points (UC) has a distance therebetween; the lower conductive points (LC) disposed on the same circumference formed by the center point of the second main body (21), and each adjacent two of the lower conductive points (LC) has a distance therebetween. By using the above configuration, during the process that the second buckle structure (122) move from one end of the groove (1121) to interior of the groove (1121), the lower conductive points (LC) sequentially contact and conduct the different upper conductive points (UC) according to the arrangement of the upper conductive points (UC), so as to achieve the safety or detection objective. For example, a lower conductive point (LC) which acts as a ground can sequentially contact and conduct the different upper conductive points (UC), so as to eliminate the fire generated by contacting and conduction of two points with two high voltages. For example, a lower conductive point (LC) which acts as a signal receiving terminal can sequentially contact and conduct the different upper conductive points (UC), so as to detect the status of the electronic apparatus of the magnetic assembly structure.

Figure 21A:
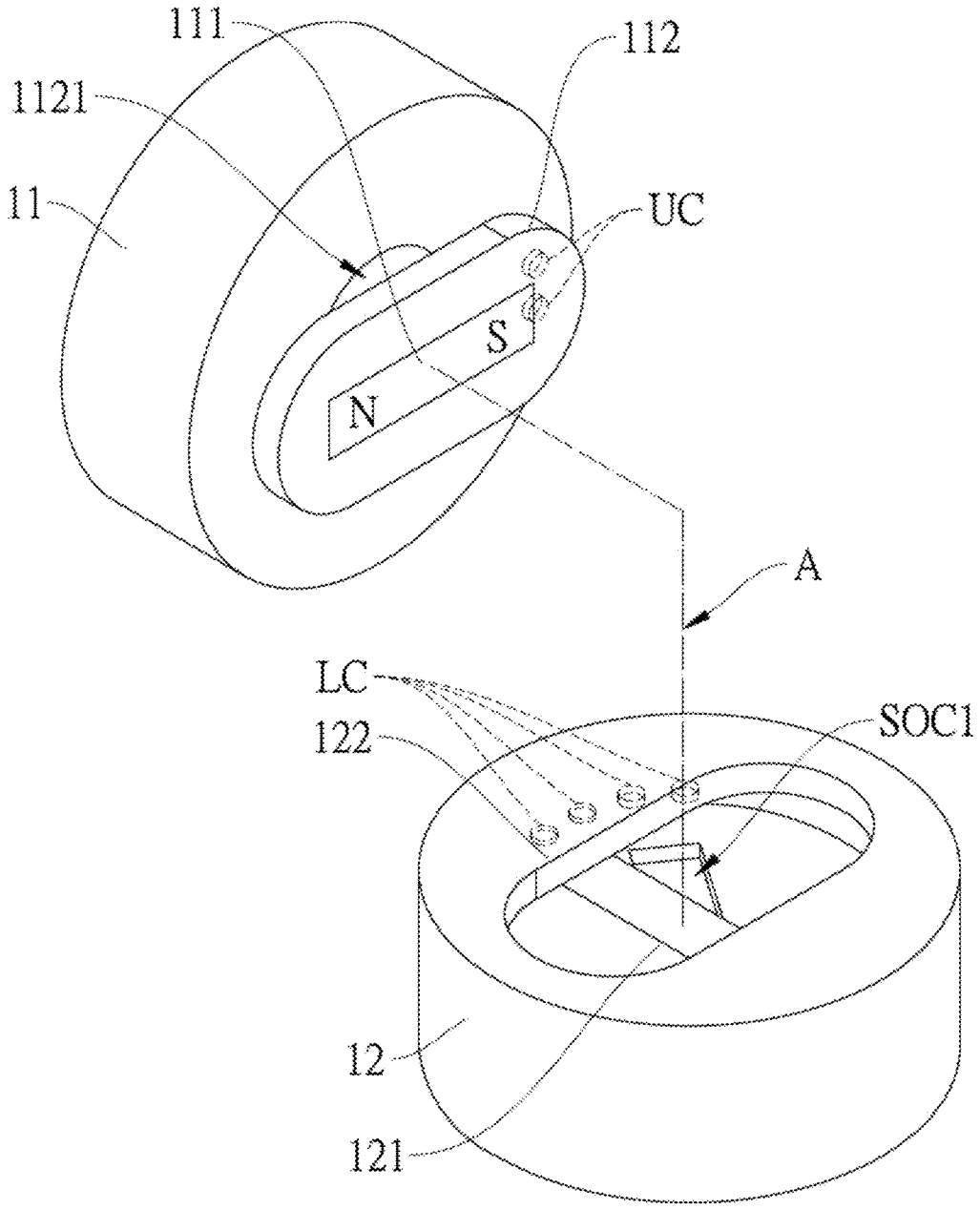
FIG. 21A is a first explosive diagram of a magnetic assembly structure according to an eighteenth embodiment of the present disclosure.
Figure 21B:
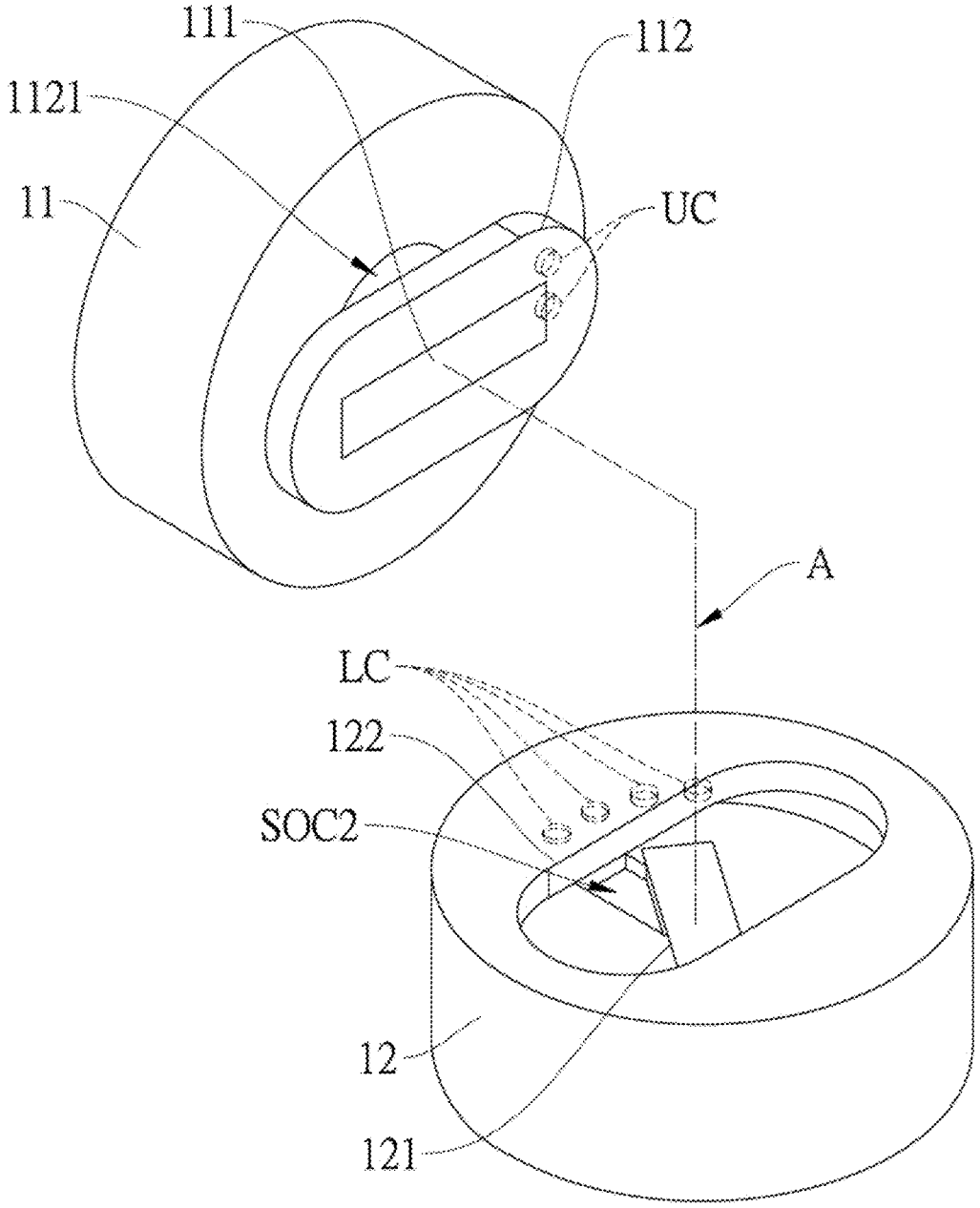
FIG. 21B is a second explosive diagram of a magnetic assembly structure according to an eighteenth embodiment of the present disclosure.
Figure 21C:
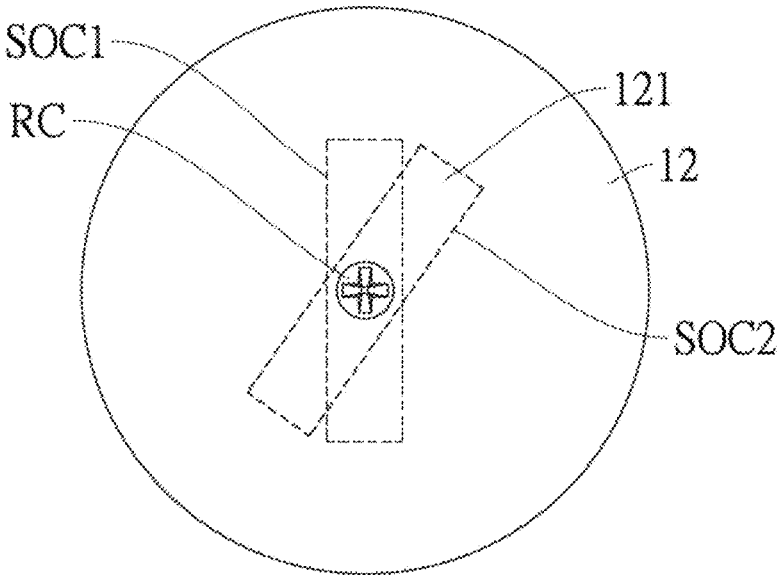
FIG. 21C is a bottom view of a second main body of FIG. 21A.
Figure 21D:
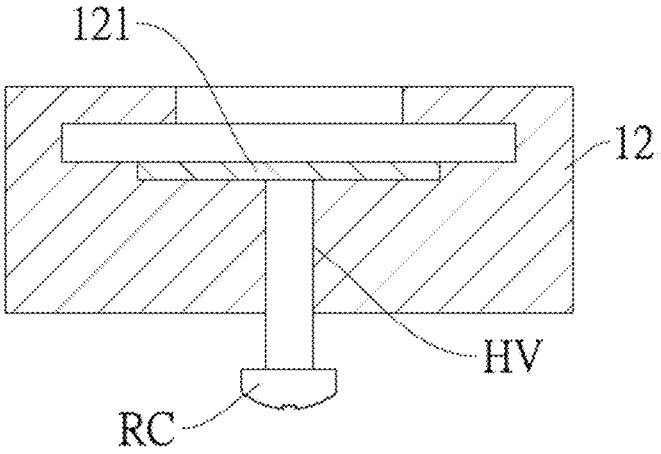
FIG. 21D is a sectional view of a second main body of FIG. 21A.

Refer to FIG. 21A through FIG. 21D, which are respectively a first explosive diagram of a magnetic assembly structure according to an eighteenth embodiment of the present disclosure, a second explosive diagram of a magnetic assembly structure according to an eighteenth embodiment of the present disclosure, is a bottom view of a second main body and a sectional view a second main body. In the embodiment, the first magnetic component (111) or the second magnetic component (121) are movable or rotatable, and can be deposed in different slots. For example, the second magnetic component (121) can be taken out to be disposed in the first slot (SOC1) or the second slot (SOC2), or alternatively, as shown in FIG. 21C and FIG. 21D, the rotating part (RC)(such as, screw or combination of nut and rod) is connected to the second magnetic component (121) via a through hole (HV) of the second main body (12), and the second magnetic component (121) can be rotated to be disposed in the first slot (SOC1) or the second slot (SOC2) by using the rotating part (RC). The upper conductive points (UC) are divided into two groups, and each of the two groups is disposed on the circumference of the center point of the first main body (11). By disposing the second magnetic component (121) in the different slots, the lower conductive points (LC) can contact and conduct the upper conductive points (UC) of the different groups, and the upper conductive points (UC) of the different groups can be used to transmit signals of different groups, for example, the a first and second HDMI signals, or USB signal and HDMI signal.

Further, in other one configuration, the upper conductive points (UC) of one group can be disposed on one of concentric circles of the center point of the first main body (11), and the upper conductive points (UC) of other one group can be disposed on another one of the concentric circles of the center point of the first main body (11). Or alternatively, in other one configuration, the upper conductive points (UC) of one group can be disposed on concentric circles of the center point of the first main body (11), and the upper conductive points (UC) of other one group can be disposed on other concentric circles of the center point of the first main body (11). In short, the configuration of the upper conductive points (UC) are not used to limit the present disclosure, but when the second main body (12) and the first main body (11) rotate in respect to each other with an angle to be limited (the rotated angle after being limited is determined by the slot which the second magnetic component (121) is disposed in), the lower conductive points (LC) and the upper conductive points (UC) of one group corresponding to the angle should contact and conduct each other. Further, though in the embodiment, merely the first slot (SOC1) and the second slot (SOC2) are illustrated as an example, there are more than two slots in the actual application, and the number of the groups of the upper conductive points (UC) are larger than two. Moreover, through in the above embodiment, the upper conductive points (UC) are divided into multiple groups as an example, in other embodiments, the lower conductive points (UC) are divided into multiple groups.

Figure 22:
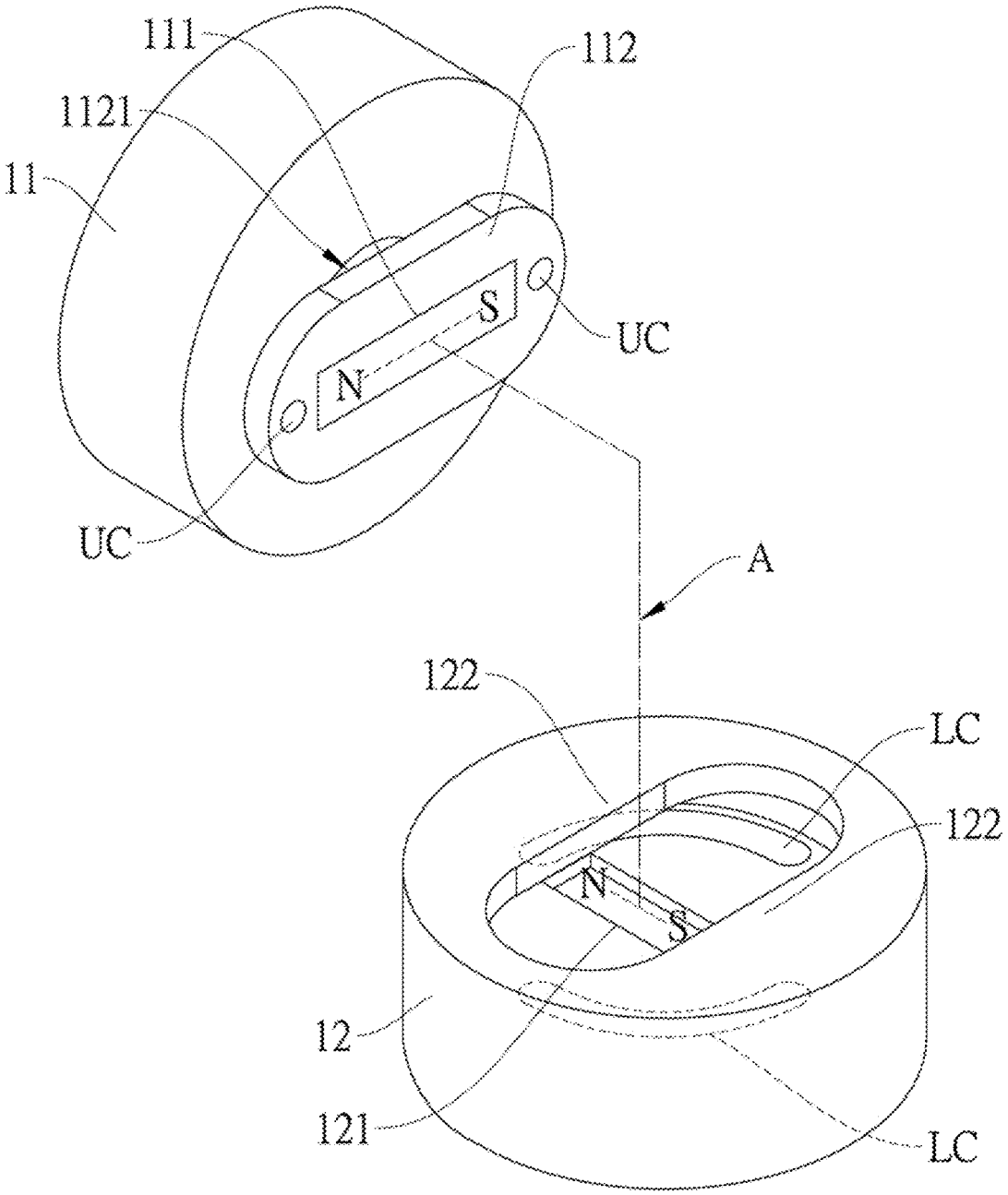
FIG. 22 is an explosive diagram of a magnetic assembly structure according to a nineteenth embodiment of the present disclosure.

Refer to FIG. 22, which is an explosive diagram of a magnetic assembly structure according to a nineteenth embodiment of the present disclosure. Compared to the fifth embodiment, in the embodiment, the shapes of the upper conductive points (UC) and/or the lower conductive points (LC) are curved sheets with curved angles being not less than 90 degrees. When installing, the upper conductive points (UC) and the lower conductive points (LC) can firstly contact and conduct each other. Then, the first main body (11) and the second main body (12) mutually generate a magnetic attraction or repulsion effect to automatically rotate the second main body (12) and first main body (11) in respect to each other, thus the first buckle structure (112) and the second buckle structure (122) are engaged to each other, and the upper conductive points (UC) and the lower conductive points (LC) maintain conductive.

According to the illustrations of the above embodiments, compared to the prior art, the magnetic assembly structure of the present disclosure has the following advantages. The magnetic assembly structure of the present disclosure, via the hardware design of disposing two magnetic components and buckle structures in the two main bodies, makes the two main bodies mutually rotate in respect to the magnetic components when the two magnetic components are affected by the magnetic attraction or repulsion effect, so as to efficiently engage the two buckle structures each other. Thus, it actually eases the installation and uninstallation of the appliance to which the magnetic assembly structure is applied, and the costs of installation and consuming time are reduced. Further, the first main body and the second main body of the magnetic assembly structure respectively have at least one upper conductive point and at least one lower conductive point, and after the two buckle structure are engaged to each other, the upper conductive point and the lower conductive point contact and conduct each other.

To sum up, the magnetic assembly structure provided by the present disclosure has been not anticipated by publications or used in public, which meets patentability of the invention. Examination of the present disclosure is respectfully requested, as well as allowance of the present disclosure.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A magnetic assembly structure, at least comprising:

a first main body, comprising at least one first buckle structure, the first buckle structure is a flange, and a top part of the first buckle structure is formed with a groove; and a second main body, comprising at least one second buckle structure, the second buckle structure is a bump, and the second buckle structure is received by the groove, such that the bump is able to move in the groove;

wherein the second main body and the first main body mutually generate a magnetic attraction or repulsion effect, so as to automatically rotate the second main body and first main body in respect to each other, and to automatically move the second buckle structure from one end of the groove to interior of the groove, thereby engaging the bump and the groove and engaging the second buckle structure and the first buckle structure;

wherein the first main body has at least one upper conductive point, the second main body has at least one lower conductive point, and after the second main body and first main body automatically rotate in respect to each other, and the bump and the groove are engaged with each other, the upper conductive point and the lower conductive point contact and conduct each other.

2. The magnetic assembly structure according to claim 1, wherein the upper conductive point is disposed on an inner side of the first buckle structure, the lower conductive point is disposed under an inner side of the second buckle structure, and the disposing position of the upper conductive point is corresponding to the disposing position of the lower conductive point.

3. The magnetic assembly structure according to claim 1, wherein the upper conductive points and the lower conductive points are positive and negative power conductive pads, positive and negative power conductive terminals, positive and negative power conductive blade sheets, positive and negative power conductive elastic sheets, signal transmission conductive terminals, signal transmission conductive blade sheets, signal transmission conductive elastic sheets or signal transmission conductive pads.

4. The magnetic assembly structure according to claim 1, wherein the upper conductive points is disposed in one position of an upper conductive point disposing space, and the upper conductive point disposing space is formed by a surface of the first buckle structure of the first main body and a lower surface of the first main body which faces the first buckle structure; the lower conductive points is disposed in one position of an lower conductive point disposing space, and the lower conductive point disposing space is formed by a surface of the second buckle structure of the second main body and an upper surface of the second main body which faces the second buckle structure.

5. The magnetic assembly structure according to claim 1, wherein the first main body further comprises at least one upper limit part, and the second main body comprises at least one lower limit part; after the second main body and first main body automatically rotate in respect to each other, and the bump and the groove are engaged with each other, the upper limit part and the lower limit part engage to each other to achieve an limit effect, and thus the upper conductive point and the lower conductive point contact and conduct each other.

6. The magnetic assembly structure according to claim 5, wherein the upper limit part is be disposed in one position of an upper limit part disposing space, and the upper limit part disposing space is formed by a surface of the first buckle structure of the first main body and a lower surface of the first main body which faces the first buckle structure; the lower limit parts is disposed in one position of an lower limit part disposing space, and the lower limit part disposing space is formed by a surface of the second buckle structure of the second main body and an upper surface of the second main body which faces the second buckle structure.

7. The magnetic assembly structure according to claim 5, wherein the upper conductive point is directly disposed on the upper limit part, and the lower conductive point is directly disposed on the lower limit part; when the upper limit part and the lower limit part are engaged to each other, the upper conductive point and the lower conductive point contact and conduct each other.

8. The magnetic assembly structure according to claim 1, wherein the shapes, dimensions and/or disposing positions of the first buckle structures are not symmetrical, and the shapes, dimensions and/or disposing positions of the second buckle structures are not symmetrical.

9. The magnetic assembly structure according to claim 8, wherein that the disposing positions of the first buckle structures are not symmetrical means the first buckle structures are asymmetrically disposed on a circumference formed by a center point of the first main body, and a central angle of the two adjacent first buckle structures in respect to the center point of the first main body is not 360/N degrees, wherein N is the number of the first buckle structures; that the disposing positions of the second buckle structures are not symmetrical means the second buckle structures are asymmetrically disposed on a circumference formed by a center point of the second main body, and a central angle of the two adjacent second buckle structures in respect to the center point of the second main body is not 360/M degrees, wherein M is the number of the second buckle structures, and M is equal to N.

10. The magnetic assembly structure according to claim 1, wherein the first main body comprises two first buckle structures, and the second main body comprises two second buckle structures; one of the first buckle structures is a flange and has a groove on its top part, and other one of the first buckle structures is a bump; correspondingly, one of the second buckle structures is a bump, and other one of the second buckle structures is a flange and has a groove on its top part.

11. The magnetic assembly structure according to claim 1, wherein the first main body comprises multiple first buckle structures, and the shape formed by the first buckle structures is a symmetrical oval structure, a symmetrical rounded square structure or a symmetrical hexagonal structure; the second main body comprises multiple second buckle structures, and the shape formed by the second buckle structures is a symmetrical oval structure, a symmetrical rounded square structure or a symmetrical hexagonal structure.

12. The magnetic assembly structure according to claim 1, wherein the first main body comprises multiple first buckle structures, and the shape formed by the first buckle structures is a right triangle structure; the second main body comprises multiple second buckle structures, and the shape formed by the second buckle structures is a right triangle structure.

13. The magnetic assembly structure according to claim 1, wherein the first main body comprises at least one first magnetic component, and the second main body comprises at least one second magnetic component.

14. The magnetic assembly structure according to claim 13, wherein after the second buckle structure moves from end of the groove to interior of the groove to be limited is a specific position, the first magnetic component and the second magnetic component are not entirely overlapped, and they have an angle, and that is, they are configured to a non-vertical arrangement status.

15. The magnetic assembly structure according to claim 14, wherein the first main body comprises multiple upper conductive points placed on the same radius of a center point of the first main body, but the distances between the upper conductive points and the center point of the first main body are different from each other; the second main body comprises multiple lower conductive points placed on the same radius of a center point of the second main body, but the distances between the lower conductive points and the center point of the second main body are different from each other.

16. The magnetic assembly structure according to claim 14, wherein the first main body comprises multiple upper conductive points placed on different radiuses of a center point of the first main body, and the distances between the upper conductive points and the center point of the first main body are different from each other; the second main body comprises multiple lower conductive points placed on the different radiuses of a center point of the second main body, and the distances between the lower conductive points and the center point of the second main body are different from each other.

17. The magnetic assembly structure according to claim 14, wherein the first main body comprises multiple upper conductive points placed on different radiuses of a center point of the first main body, but the distances between the upper conductive points and the center point of the first main body are identical to each other; the second main body comprises multiple lower conductive points placed on the different radiuses of a center point of the second main body, but the distances between the lower conductive points and the center point of the second main body are identical to each other.

18. The magnetic assembly structure according to claim 13, wherein the first magnetic component or the second magnetic component are movable or rotatable.

19. The magnetic assembly structure according to claim 18, wherein the upper conductive points are divided into two groups, and each of the two groups is disposed on a circumference of a center point of the first main body; or alternatively, the upper conductive points of one group is disposed on one of concentric circles of the center point of the first main body, and the upper conductive points of other one group is disposed on another one of the concentric circles of the center point of the first main body; or alternatively, the upper conductive points of one group is disposed on concentric circles of the center point of the first main body, and the upper conductive points of other one group is disposed on other concentric circles of the center point of the first main body.

20. A magnetic assembly structure, at least comprising:

a first main body, comprising at least one first buckle structure and at least one upper conductive point; and a second main body, comprising at least one second buckle structure and at least one lower conductive point;

wherein the second main body and the first main body mutually generate a magnetic attraction or repulsion effect, so as to automatically rotate the second main body and first main body in respect to each other, thereby engaging the second buckle structure and the first buckle structure, and making the upper conductive point and the lower conductive point contact and conduct each other.

21. A magnetic assembly structure, at least comprising: a first main body, comprising at least one first buckle structure and multiple upper conductive points; and a second main body, comprising at least one second buckle structure and multiple lower conductive points; wherein the upper conductive points and the lower conductive points contact and conduct each other firstly, and then the second main body and the first main body mutually generate a magnetic attraction or repulsion effect, so as to automatically rotate the second main body and first main body in respect to each other, thereby engaging the second buckle structure and the first buckle structure.

* * * * *